US011155435B2

(12) United States Patent
Worthington

(10) Patent No.: US 11,155,435 B2
(45) **Date of Patent: *Oct. 26, 2021**

(54) DISPENSER

(71) Applicant: Melitta UK Ltd, Telford (GB)

(72) Inventor: Simon Worthington, Telford (GB)

(73) Assignee: MELITTA UK LIMITED, Telford (GB)

( * ) Notice: Subject to any disclaimer, the term of this patent is extended or adjusted under 35 U.S.C. 154(b) by 292 days.

This patent is subject to a terminal disclaimer.

(21) Appl. No.: 16/130,090

(22) Filed: Sep. 13, 2018

(65) Prior Publication Data

US 2019/0084789 A1 Mar. 21, 2019

(30) Foreign Application Priority Data

Sep. 15, 2017 (GB) ..... 1714865

(51) Int. Cl.
*B65H 75/28* (2006.01)
*B65H 16/00* (2006.01)
(Continued)

(52) U.S. Cl.
CPC ..... *B65H 75/285* (2013.01); *A47K 10/3845* (2013.01); *B65H 16/005* (2013.01);
(Continued)

(58) Field of Classification Search
CPC .... B65H 75/285; B65H 16/06; B65H 75/242; B65H 75/26; B65H 75/185; B65H 16/005;
(Continued)

(56) References Cited

U.S. PATENT DOCUMENTS 5,261,623 A 11/1993 Dominesey et al.
7,364,112 B1 * 4/2008 Formon ..... B65H 75/185 242/599.4
(Continued)

FOREIGN PATENT DOCUMENTS

CN 200967692 Y 10/2007
EP 0103659 A1 3/1984
(Continued)

OTHER PUBLICATIONS

Search Report dated Mar. 7, 2018 in United Kingdom Patent Application No. GB1714865.1.
(Continued)

*Primary Examiner* — William A. Rivera
(74) *Attorney, Agent, or Firm* — FisherBroyles, LLP; Robert Kinberg

(57) ABSTRACT

A sheet dispenser system having a roll of sheet material and a housing to receive the roll. The roll of sheet material comprises a first end portion incorporating a key, and the housing comprises a mounting portion arranged to support the first end portion of the roll. The mounting portion comprises a lock arrangement which is movable between a locked condition and a free condition. The lock arrangement comprises a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition. The mounting portion is arranged such that the roll is movable between an engaged condition, in which the key engages the mounting portion, and a disengaged condition, in which the key is disengaged from the mounting portion, such that, when the roll is moved
(Continued)

from the disengaged to the engaged condition, the first end portion of the roll moves the lock arrangement into the free condition, thereby permitting rotation of the rotatable element. The locking element and the rotatable element are configured for engagement by relative movement of the locking element and the rotatable element towards each other in a direction along the axis of rotation of the rotatable element.

20 Claims, 27 Drawing Sheets

(51) Int. Cl.

| | |
|---|---|
| ***B65H 75/18*** | (2006.01) |
| ***B65H 16/06*** | (2006.01) |
| ***B65H 19/12*** | (2006.01) |
| ***B65H 35/00*** | (2006.01) |
| ***A47K 10/38*** | (2006.01) |
| ***B65H 75/24*** | (2006.01) |

(52) U.S. Cl.
CPC ..... *B65H 16/06* (2013.01); *B65H 19/126* (2013.01); *B65H 35/002* (2013.01); *B65H 75/185* (2013.01); *B65H 75/242* (2013.01); *B65H 2301/4134* (2013.01); *B65H 2301/4135* (2013.01); *B65H 2301/41335* (2013.01); *B65H 2301/41346* (2013.01); *B65H 2301/41366* (2013.01); *B65H 2301/41369* (2013.01); *B65H 2301/413665* (2013.01); *B65H 2402/61* (2013.01); *B65H 2402/63* (2013.01); *B65H 2402/64* (2013.01); *B65H 2701/1944* (2013.01)

(58) Field of Classification Search
CPC ..... B65H 2301/41346; B65H 2301/41369; B65H 2402/63; B65H 19/126; B65H 2407/11; B65H 2301/41335; B65H 2301/4134; B65H 2402/61; B65H 2402/64; B65H 75/18
See application file for complete search history.

(56) References Cited

U.S. PATENT DOCUMENTS

| | | | | |
|---|---|---|---|---|
| 8,899,510 | B2 * | 12/2014 | Dean | B65H 75/185 242/596.7 |
| 10,172,501 | B2 * | 1/2019 | Gscheidmeier | A47K 10/38 |
| 2008/0230418 | A1 * | 9/2008 | Lind | B65H 75/14 206/413 |

FOREIGN PATENT DOCUMENTS

| | | | | |
|---|---|---|---|---|
| EP | 2451733 | B1 | 12/2015 | |
| EP | 2686262 | B1 | 3/2017 | |
| GB | 2104871 | A | 3/1983 | |
| GB | 2508880 | A | 6/2014 | |
| GB | 2513429 | A | 10/2014 | |
| WO | 2011036430 | A9 | 3/2011 | |
| WO | WO-2014091247 | A2 * | 6/2014 | B65H 19/126 |
| WO | 2015036832 | A1 | 3/2015 | |

OTHER PUBLICATIONS

European Search Report in related European Patent Application No. 18174778.3, dated Jan. 23, 2019, 4 pages.
Great Britain Search Report in related Great Britain Patent application No. 1714866.9, date of search Feb. 28, 2018, 3 pages.
Chinese Search Report in related Chinese Patent Application No. 201880073635.0, dated Mar. 1, 2021, 24 pages with English Google Translation.
Chinese Search Report in related Chinese Patent Application No. 21880073651.X, dated Mar. 1, 2021, 24 pages with English Google Translation.

* cited by examiner

DISPENSER

CROSS-REFERENCE TO RELATED APPLICATION

This application claims the benefit of United Kingdom Patent Application No. 1714865.1 filed on Sep. 15, 2017, the disclosure of which is incorporated herein by reference in its entirety.

FIELD

The present disclosure relates to a sheet dispenser for a roll of sheet material, a sheet dispenser system having a roll of sheet material, a mounting system for a sheet dispenser having a roll of sheet material, and a roll for use with such a dispenser and systems.

BACKGROUND

Conventionally, sheet dispensers comprise a housing and a mounting for removably mounting a roll of sheet material, such as cling film, foil and greaseproof paper, to the housing. The mounting permits rotational movement of the roll to the housing, so that material wound around the roll can be unwound for dispensing.

When the material is exhausted from the roll, the roll is dismounted and a fresh roll with new material is mounted in the housing.

It can be important for manufacturers of the material to ensure that only specific material is used within the housing to ensure that quality is maintained. In some known dispensers it is possible for rolls containing the wrong material, or material of an incorrect grade or dimensions to be loaded into the dispenser and usability of the dispenser to be impaired.

WO 2011/036430 discloses a dispenser including a housing, a coupling associated with a reel and a mounting for removably mounting the coupling to the housing so that the coupling is movable between a mounted and a dismounted condition. The coupling includes a key. The mounting includes a lock arrangement which is movable between a locked condition and a free condition. The reel dispenser is arranged so that when the coupling is moved from the dismounted condition to the mounted condition, the key moves the lock arrangement to the free condition, permitting rotation of the coupling relative to the housing.

In such a dispenser, locking of the lock arrangement relies on gravity to move the lock arrangement into the locked position, i.e. for the locking to occur.

The present disclosure seeks to overcome or at least mitigate the problems of the prior art to provide an improved dispenser.

SUMMARY

According to a first aspect of the invention, there is provided a sheet dispenser system having a roll of sheet material and a housing to receive the roll, wherein: the roll of sheet material comprises a first end portion incorporating a key; and the housing comprises a mounting portion arranged to support the first end portion of the roll; wherein the mounting portion comprises a lock arrangement which is movable between a locked condition and an free condition; wherein the lock arrangement comprises a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition; wherein the mounting portion is arranged such that the roll is movable between an engaged condition, in which the key engages the mounting portion, and a disengaged condition, in which the key is disengaged from the mounting portion, such that, when the roll is moved from the disengaged to the engaged condition, the first end portion of the roll moves the lock arrangement into the free condition, thereby permitting rotation of the rotatable element; and wherein the locking element and the rotatable element are configured for engagement by relative movement of the locking element and the rotatable element towards each other in a direction along the axis of rotation of the rotatable element.

In some embodiments, when the roll is loaded in the housing, the axis of rotation of the rotatable element is provided along the axis of rotation of the roll. In addition, in some embodiments, to load a roll into a dispenser housing, a force is applied in a direction along the longitudinal axis of the roll, towards the mounting portion, to secure the roll in the mounting portion. In this way, axial movement of the roll (i.e. along the axis of rotation of the roll, which is also along the axis of rotation of the rotatable element) to load the roll into the mounting portion can be used to cause the locking element and the rotatable element to disengage from one another, such that the rotatable element is free to rotate.

Since the rotatable element and the locking element are configured for engagement by relative movement of the locking element and the rotatable element towards each other in a direction along the axis of rotation of the rotatable element, movement of the roll can be used to disengage the rotatable element and the locking element. The arrangement does not require translation of the direction of the force applied by the roll into a force in a different direction, e.g. transverse to the longitudinal axis of the roll or transverse to the axis of rotation of the rotatable element, in order to disengage the locking element and rotatable element. In this way, a more robust lock arrangement is provided.

The mounting portion may comprise a biasing mechanism arranged to bias the lock arrangement into the locked condition, in which rotation of the rotatable element is inhibited.

In this way a more reliable lock arrangement is provided, which must be actively moved from the locked to the free condition, against the action of the biasing mechanism, in order for rotation of the rotatable element to be permitted.

The biasing mechanism(s) may be provided by a spring or other suitable resilient member.

The spring rate of the biasing mechanism(s) may be selected to be a predetermined value, for example it may be selected to be approximately 3N. This is advantageous to ensure that appropriate tactile feedback is provided to a user when loading or unloading a roll in the dispenser.

The biasing mechanism is arranged to bias the locking element into engagement with the rotatable element, or vice versa.

The mounting portion may be configured such that, when the rotatable element is free to rotate, rotation of the roll in the housing is permitted.

The rotatable element may be configured to support the first end portion of the roll.

In this way, rotation of the rotatable portion causes rotation of the roll, and vice versa, when the lock arrangement is in the free condition, i.e. when the rotatable portion is free to rotate.

The locking element may be fixed against rotation.

Accordingly, when the locking element and rotatable element are engaged, rotation of the rotatable element is inhibited.

The locking element and rotatable element may comprise a projection and corresponding recess configured for engagement upon relative movement of the locking element towards the rotatable element in a direction along the axis of rotation of the rotatable element such that, when the projection engages the corresponding recess, rotation of the rotatable element is inhibited.

The lock arrangement may comprise a plurality of configurations which correspond to the locked condition.

In this way, the rotatable element and the locking element can be brought into engagement in a plurality of relative orientations. Consequently, locking of the lock arrangement is facilitated.

The locking element and rotatable element comprise a plurality of projections and corresponding recesses which are configured for engagement upon relative movement of the locking element towards the rotatable element in a direction along the axis of rotation of the rotatable element, such that, when the projections engage the corresponding recesses, rotation of the rotatable element is inhibited.

The projections and corresponding recesses may be provided in a circular arrangement centred about the axis of rotation of the rotatable element.

Advantageously, such a circular arrangement maximises the number of configurations which correspond to the locked condition of the lock arrangement.

The projections may be provided by an array of teeth on the rotatable element or locking element. The recesses may be provided between splines of an array of splines on the locking element or rotatable element.

The one or more projections and the one or more recesses may be arranged to self-align when the locking element and the rotatable element are biased into contact.

In this way, locking of the lock arrangement is facilitated irrespective of the relative orientation of the rotatable element and locking element.

The locking element may be configured to be retracted out of engagement with the rotatable element by movement of the first end portion of the roll as the roll is moved from the disengaged to the engaged position.

As the roll is moved from the disengaged to the engaged condition, the first end portion of the roll may be configured to abut a portion of the locking element to disengage the locking element from the rotatable element.

The key may comprise one or more projections. The mounting portion may define one or more corresponding keyholes configured to receive the one or more projections of the key to support the first end of the roll.

The rotatable element may comprise the one or more keyholes.

The key of the first end portion may be configured to abut a portion of the locking element to disengage the locking element from the rotatable element.

The rotatable element may be configured to be retracted out of engagement with the locking element by movement of the first end portion of the roll, as the roll is moved from the disengaged to the engaged position.

As the roll is moved from the disengaged to the engaged condition, the first end portion of the roll may be configured to abut a portion of the rotatable element to disengage the rotatable element from the locking element.

The key may comprise one or more depressions or recesses. The mounting portion may comprise one or more corresponding formations configured to be received by the one or more depressions or recesses of the key to support the first end of the roll.

The rotatable element may comprise the one or more formations.

An axial end face of the first end portion of the roll may be configured to engage the rotatable element to move it out of engagement with the locking element.

The housing may further comprise a support portion arranged to support a second end of the roll. The mounting portion may further comprise a tilting member pivotally coupled to the housing to define an operative position, in which the mounting portion and the support portion are aligned to support the roll in the housing, and a loading position, in which the mounting portion and the support portion are unaligned to inhibit support of the roll in the housing.

The mounting portion may further comprise a block arrangement which is movable between a blocked condition, in which movement of the tilting member from the loading position to the operative position is inhibited, and an unblocked condition, in which movement of the tilting member from the loading position to the operative position is permitted. The mounting portion may be arranged such that, when the roll is moved from the disengaged to the engaged condition, the first end portion of the roll moves the block arrangement into the unblocked condition, thereby permitting movement of the tilting member from the loading position to the operative position.

When a user inserts a roll into the dispenser, the key of the first end portion of the roll is moved into engagement with the mounting portion. As the key is engaged with the mounting portion, the first end portion of the roll moves the block arrangement into the unblocked condition. This releases the tilting member for rotation about the pivot axis, thereby permitting movement of the tilting member between the loading position and the operative position.

Once the tilting member is released for rotation, the force applied by the user to insert the roll into the dispenser causes the tilting member to pivot from the loading position to the operative position. The loading position may be configured to facilitate loading of the roll in the dispenser, for example, in the loading position, the tilting member may be angled towards the user. Such a configuration of the mounting portion makes it easier for a user of the dispenser to insert a roll, because the mounting portion is alignable with the roll, rather than requiring a user to align the roll with the mounting portion.

If the tilting member were to be fixed in the operative position, the tilting member would remain in alignment with the support portion. Consequently, loading of a roll into the dispenser may be more difficult for a user, since the user is required to align the roll with the mounting portion.

Further, in order for the roll to be engaged with the mounting portion it must comprise a key which is configured to engage the mounting portion, such that, when the key is engaged, the first end portion of the roll moves the block arrangement of the mounting portion to the unblocked condition. In this way movement of the tilting member from the loading position to the operative position is permitted. If a user attempts to load a roll without the required key into the dispenser, it will not be possible to unblock the block arrangement, hence movement of the tilting member from the loading condition to the operative condition will be inhibited.

In this event, the mounting portion and the support portion will remain unaligned, hence support of the roll in the housing will be inhibited. Consequently only rolls with the required key can be mounted in the housing. In this way, it is possible to ensure that only rolls containing the correct material, or material of a correct grade or dimensions, can be loaded in the dispenser.

The block arrangement may comprise a blocking element actuatable by the first end portion of the roll to move the block arrangement from the blocked condition to the unblocked condition. The locking element and the blocking element may be provided by the same component.

The block arrangement may comprise a blocking element actuatable by the first end portion of the roll to move the block arrangement from the blocked condition to the unblocked condition. The rotatable element and the blocking element may be provided by the same component.

It will be appreciated that, in embodiments comprising both a block arrangement and a lock arrangement, the action of loading the roll of material into the mounting portion can provide two effects: unlocking the lock arrangement to free rotation of the rotatable element, and unblocking the block arrangement to free the tilting member for rotation about its pivot. In other words, a single action by the user results in two effects in the mounting portion.

According to a second aspect of the invention, there is provided a mounting system for a sheet dispenser having a roll of sheet material and a housing to receive the roll, wherein the mounting system comprises: a first end portion of a roll of sheet material incorporating a key; and a corresponding mounting portion of a housing, the mounting portion arranged to support the first end portion of the roll; wherein the mounting portion comprises a lock arrangement which is movable between a locked condition and an free condition; wherein the lock arrangement comprises a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition; wherein the mounting portion is arranged such that the first end portion of the roll is movable between an engaged condition, in which the key engages the mounting portion, and a disengaged condition, in which the key is disengaged from the mounting portion, such that, when the first end portion of the roll is moved from the disengaged to the engaged condition, the first end portion moves the lock arrangement into the free condition, thereby permitting rotation of the rotatable element; and wherein the locking element and the rotatable element are configured for engagement by relative movement of the locking element and the rotatable element in a direction towards each other along the axis of rotation of the rotatable element.

According to a third aspect of the invention there is provided a sheet dispenser comprising a housing for receiving a roll of sheet material, the roll comprising a first end portion incorporating a key, wherein: the housing comprises a mounting portion arranged to support said first end portion of said roll; wherein the mounting portion comprises a lock arrangement which is movable between a locked condition and a free condition; wherein the lock arrangement comprises a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition; wherein the mounting portion is arranged such that said first end portion of said roll is movable between an engaged condition, in which said key engages the mounting portion, and a disengaged condition, in which said key is disengaged from the mounting portion, such that, when said first end portion of said roll is moved from the disengaged to the engaged condition, said first end portion moves the lock arrangement into the free condition, thereby permitting rotation of the rotatable element; and wherein the locking element and the rotatable element are configured for engagement by relative movement of the locking element and the rotatable element towards each other in a direction along the axis of rotation of the rotatable element.

The housing may further comprises a support portion arranged to support a second end of the roll. The mounting portion may further comprise a tilting member pivotally coupled to the housing to define an operative position, in which the mounting portion and the support portion are aligned to support the roll in the housing, and a loading position, in which the mounting portion and the support portion are unaligned to inhibit support of the roll in the housing. The mounting portion may further comprise a block arrangement which is movable between a blocked condition, in which movement of the tilting member from the loading position to the operative position is inhibited, and a unblocked condition, in which movement of the tilting member from the loading position to the operative position is permitted. The mounting portion may be arranged such that, when the roll is moved from the disengaged to the engaged condition, the first end portion of the roll moves the block arrangement into the unblocked condition, thereby permitting movement of the tilting member from the loading position to the operative position.

The roll may comprise a first end portion having a key. The key may comprise one or more depressions or recesses in an axial end face of the first end portion of the roll. The one or more depressions or recesses may be configured to receive one or more corresponding formations provided by a mounting portion of a dispenser housing.

According to a fourth aspect of the invention there is provided a replacement roll of material for use with a sheet dispenser according to the third aspect of the invention, wherein the replacement roll of material comprises one or more mounting formations which are arranged to be supported by the mounting portion of the sheet dispenser when the lock arrangement is in the free condition.

According to a fifth aspect of the invention there is provided a sheet dispenser system comprising a sheet dispenser according to the third aspect of the invention and a replacement roll of material, wherein the replacement roll of material comprises one or more mounting formations which are arranged to be supported by the mounting portion of the sheet dispenser when the lock arrangement is in the free condition.

According to a sixth aspect of the invention there is provided a use of a replacement roll of sheet material with a sheet dispenser according to the third aspect of the invention, wherein the replacement roll comprises one or more mounting formations and the mounting portion of the dispenser comprises one or more complimentary formations configured to support the one or more mounting formations of the replacement roll, and wherein the use comprises mounting the one or more formations of the replacement roll onto the one or more complimentary formations of the mounting portion of the sheet dispenser.

According to a seventh aspect of the invention, there is provided a method of mounting a replacement roll of sheet material into a sheet dispenser according to the third aspect of the invention, comprising the steps of: a) moving a key from the disengaged to the engaged condition such that the lock arrangement is moved into the free condition, in which rotation of the rotatable element is permitted; and b) mounting a first end of the replacement roll into the mounting portion of the dispenser.

According to an eighth aspect of the invention, there is provided a method of removing a roll of sheet material from a sheet dispenser according to the third aspect of the invention, wherein the mounting portion of the sheet dispenser comprises a biasing mechanism arranged to bias the lock arrangement to the locked condition, comprising the steps of: a) dismounting a roll of sheet material from the mounting portion of the housing; and b) releasing the lock arrangement for movement, such that the lock arrangement is moved, under the biasing action of the biasing mechanism, to the locked condition in which rotation of the rotatable element is inhibited.

According to a ninth aspect of the invention, there is provided a replacement roll of material for use with a sheet dispenser according to the third aspect of the invention, wherein the replacement roll of material comprises one or more mounting formations which are arranged to be supported by the mounting portion of the sheet dispenser when the block arrangement is in the unblocked condition and/or when the lock arrangement is in the free condition.

According to a tenth aspect of the invention, there is provided a sheet dispenser system comprising a sheet dispenser according to the third aspect of the invention and a replacement roll of material, wherein the replacement roll of material comprises one or more mounting formations which are arranged to be supported by the mounting portion of the sheet dispenser when the block arrangement is in the unblocked configuration and/or when the lock arrangement is in the free condition.

According to an eleventh aspect of the invention, there is provided a method of mounting a replacement roll of sheet material into a sheet dispenser according to the third aspect of the invention, comprising the steps of: a) moving a key from the disengaged to the engaged condition such that the block arrangement is moved into the unblocked condition, in which movement of the tilting member from the loading position to the operative position is permitted; and/or b) moving a key from the disengaged to the engaged condition such that the lock arrangement is moved into the free condition, in which rotation of the rotatable element is permitted; and mounting a first end of the replacement roll into the mounting portion of the dispenser.

According to a twelfth aspect of the invention there is provided a method of removing a roll of sheet material from a sheet dispenser according to the third aspect of the invention, wherein the mounting portion of the sheet dispenser comprises a biasing mechanism arranged to bias the tilting member towards the loading position, the method comprising the steps of: a) dismounting a roll of sheet material from the mounting portion of the housing; and b) releasing the tilting member for movement, such that the tilting member is moved from the operative position to the loading position under the biasing action of the biasing mechanism.

According to a thirteenth aspect of the invention, there is provided a method of removing a roll of sheet material from a sheet dispenser according to the third aspect of the invention, wherein the mounting portion of the sheet dispenser comprises a biasing mechanism arranged to bias the block arrangement to the blocked condition, comprising the steps of: a) dismounting a roll of sheet material from the mounting portion of the housing; and b) releasing the block arrangement for movement, such that the block arrangement is moved, under the biasing action of the biasing mechanism, to the blocked condition in which movement of the tilting member from the loading position to the operative position is inhibited.

According to a fourteenth aspect of the invention, there is provided a sheet dispenser system having a roll of sheet material and a housing to receive the roll, wherein: the roll of sheet material comprises a first end portion incorporating a key; and the housing comprises a mounting portion arranged to support the first end portion of the roll and a support portion arranged to support a second end of the roll; wherein the mounting portion comprises a tilting member pivotally coupled to the housing to define an operative position, in which the mounting portion and the support portion are aligned to support the roll in the housing, and a loading position, in which the mounting portion and the support portion are unaligned to inhibit support of the roll in the housing; wherein the mounting portion comprises a block arrangement which is movable between a blocked condition, in which movement of the tilting member from the loading position to the operative position is inhibited, and a unblocked condition, in which movement of the tilting member from the loading position to the operative position is permitted; and wherein the mounting portion is arranged such that the roll is movable between an engaged condition, in which the key engages the mounting portion, and a disengaged condition, in which the key is disengaged from the mounting portion, such that, when the roll is moved from the disengaged to the engaged condition, the first end portion of the roll moves the block arrangement into the unblocked condition, thereby permitting movement of the tilting member from the loading position to the operative position.

When a user inserts a roll into the dispenser, the key of the first end portion of the roll is moved into engagement with the mounting portion. As the key is engaged with the mounting portion, the first end portion of the roll moves the block arrangement into the unblocked condition. This releases the tilting member for rotation about the pivot axis, thereby permitting movement of the tilting member between the loading position and the operative position.

Once the tilting member is released for rotation, the force applied by the user to insert the roll into the dispenser causes the tilting member to pivot from the loading position to the operative position. The loading position may be configured to facilitate loading of the roll in the dispenser, for example, in the loading position, the tilting member may be angled towards the user. Such a configuration of the mounting portion makes it easier for a user of the dispenser to insert a roll, because the mounting portion is alignable with the roll, rather than requiring a user to align the roll with the mounting portion.

If the tilting member were to be fixed in the operative position, the tilting member would remain in alignment with the support portion. Consequently, loading of a roll into the dispenser may be more difficult for a user, since the user is required to align the roll with the mounting portion.

Further, in order for the roll to be engaged with the mounting portion it must comprise a key which is configured to engage the mounting portion, such that, when the key is engaged, the first end portion of the roll moves the block arrangement of the mounting portion to the unblocked condition. In this way movement of the tilting member from the loading position to the operative position is permitted. If a user attempts to load a roll without the required key into the dispenser, it will not be possible to unblock the block arrangement, hence movement of the tilting member from the loading condition to the operative condition will be inhibited.

In this event, the mounting portion and the support portion will remain unaligned, hence support of the roll in the housing will be inhibited. Consequently only rolls with the required key can be mounted in the housing. In this way, it is possible to ensure that only rolls containing the correct material, or material of a correct grade or dimensions, can be loaded in the dispenser.

When aligned, the mounting portion and the support portion may be aligned along a longitudinal axis of the housing.

When the roll is supported by the mounting portion and the support portion, the axis of the roll may be provided along the longitudinal axis of the housing. In other words, the mounting portion and the support portion may be aligned along a longitudinal axis of the roll.

The support portion may be stationary along an axial length of the housing, i.e. the support portion may not pivot within the housing. Alternatively, both the tilting portion and the support portion may be pivotable within the housing.

The tilting member may be substantially aligned with an axial end face of a first end portion of a roll of sheet material in the loading position and in the operative position. As such, in the operative position the tilting member may be angled substantially perpendicular to a longitudinal axis defined by a longitudinal length of the housing. The tilting member may be rotated through 20 to 60° between the operative position and the loading position, for example 30 to 40°, for example 35 to 45°. As such, in the loading position the tilting member may be angled at approximately 30 to 70° to a longitudinal axis defined by a longitudinal length of the housing. Consequently, loading of a roll into the dispenser is facilitated.

The mounting portion may comprise a biasing mechanism configured to bias the block arrangement into the blocked condition.

In this way, a more reliable block arrangement is provided, which must be actively moved from the blocked condition to the unblocked condition, against the action of the biasing member, in order for a roll to be supported in the housing for use.

The mounting portion may comprise a biasing mechanism configured to bias the tilting member towards the loading position.

The biasing mechanism may be configured to bias the tilting member towards the loading position and may be configured to bias the block arrangement into the blocked condition.

The dispenser may comprise a first biasing mechanism configured to bias the tilting member towards the loading position, and a separate second biasing mechanism configured to bias the block arrangement into the blocked condition.

The biasing mechanism(s) may be provided by a spring or other suitable resilient member.

The spring rate of the biasing mechanism(s) may be selected to be a predetermined value, for example it may be selected to be approximately 3N. This is advantageous to ensure that the (first) biasing mechanism can overcome the force of gravity to return the tilting member to the loading position.

Selection of an appropriate spring rate of the biasing mechanism(s) is also beneficial to provide appropriate tactile feedback to a user when loading or unloading a roll in the dispenser.

The tilting portion may be arranged to support the first end portion of the roll.

The block arrangement may comprise a blocking element actuatable by the first end portion of the roll to move the block arrangement from the blocked condition to the unblocked condition.

The tilting member may move through an arc of rotation as it is moved from the loading condition to the operative condition. Actuation of the blocking element by the first end portion of the roll may comprise movement of the blocking element in a direction along a tangent of the arc of rotation of the tilting member.

When a user inserts a roll into the dispenser, the key of the first end portion of the roll is moved into engagement with the mounting portion and the block arrangement may be moved into the unblocked condition by the first end portion of the roll. Once the block arrangement is in the unblocked condition, the force applied by the user to insert the roll into the dispenser causes the tilting member to rotate about its pivot axis, following an arc of rotation as it moves from the loading position to the operative position. It will be appreciated that the force applied by the user to insert the roll will be substantially in a direction along a tangent of the arc of rotation.

In the case where movement of the blocking element is in a direction substantially along a tangent of the arc of rotation, the movement of the blocking element is in substantially the same direction as the force applied by the user to insert the roll into the container. In this way, force applied by the user is simply converted into movement of the blocking element to unblock the block arrangement and permit movement of the tilting member from the loading configuration to the operative configuration.

The tilting member may comprise a surface configured such that, when the tilting member is in the operative position, the surface extends in a direction substantially orthogonal to a longitudinal axis of the housing and, when the tilting member is in the loading position, the surface extends at an angle less than 90° to the longitudinal axis. Actuation of the blocking element by the first end portion of the roll may comprise movement of the blocking element in a direction substantially perpendicular to the surface.

The first end portion of the roll may comprise an axial end face configured for engagement with the surface of the tilting member. In this way, the force which must be applied by a user to move the tilting member from the loading position to the operative position is reduced.

It will be appreciated that, when the tilting member is in the operative position, whilst the surface extends in a direction substantially orthogonal to the longitudinal axis, the surface of the tilting member may be less than 90° to the longitudinal axis, e.g. slightly less than 90° to the longitudinal axis. For example, manufacturing tolerances may mean that a slightly shorter roll is loaded into the housing. In the case where the tilting member is biased towards the loading position by a biasing mechanism, the biasing force applied to move the tilting member towards the loading position ensures that the slightly shorter roll is robustly supported in the dispenser.

The block arrangement may comprise a block formation, wherein the blocking element is configured to engage the block formation to inhibit movement of the tilting member from the loading position to the operative condition.

Actuation of the blocking element may comprise movement of the blocking element out of engagement with the block formation.

In this way, a simple arrangement is provided in which movement of the tilting member from the loading position to the operative condition is inhibited when the block arrangement is in the blocked condition, i.e. when the blocking element engages the block formation.

The blocking element may be biased by a biasing mechanism into engagement with the block formation.

The block formation may comprise one or more stop portions arranged for engagement with the blocking element to inhibit movement of the tilting member from the loading position to the operative position.

The blocking element may comprise a body having at least one wing extending therefrom. The at least one wing may be arranged for engagement with the one or more stop portions when the block arrangement is in the blocked condition.

The mounting portion may comprise guide elements to guide the movement of the blocking element as it is moved out of and into engagement with the block formations.

Correct positioning of the blocking element with respect to the block formations in the way facilitates engagement and disengagement of the blocking element and block formations, hence providing a more robust block arrangement.

The mounting portion may comprise one or more stop elements arranged to limit the angle through which the tilting portion can rotate between the operative position and the loading position.

Accordingly, an optimum loading angle can be predetermined and set by the position of the stop elements of the mounting portion, optimising the ease with which a user can load a roll into the dispenser.

The key may comprise one or more projections. The mounting portion may define one or more corresponding keyholes configured to receive the one or more projections of the key to support the first end portion of the roll.

In this way, only rolls having a key which corresponds to the keyholes of the mounting portion can be properly inserted into the housing.

The tilting member may comprise the one or more keyholes.

When the roll is moved from the disengaged condition to the engaged condition, the key may move the block arrangement into the unblocked condition.

The block arrangement may comprise a blocking element actuatable by the key to move the block arrangement from the blocked condition to the unblocked condition.

In this way, the first end portion of the roll comprises a projecting key formation which is configured to move the block arrangement from the blocked to the unblocked condition, as the roll is moved from the disengaged to the engaged condition, e.g. by actuation or movement of the blocking element.

The key may comprise one or more depressions or recesses in an axial end face of the first end portion of the roll. The mounting portion may comprise one or more corresponding formations configured to be received by the one or more depressions or recesses of the key to support the first end portion of the roll.

The tilting member may comprise the one or more formations.

When the roll is moved from the disengaged condition to the engaged condition, the axial end face of the first end portion may move the block arrangement into the unblocked condition.

The block arrangement may comprise a blocking element actuatable by the axial end face of the first end portion of the roll to move the block arrangement from the blocked condition to the unblocked condition.

In this way, the formations of the mounting portion are received by the depressions or recesses of the key as the roll is moved from the disengaged to the engaged condition. As the roll is moved towards the mounting portion, the axial end face of the first end portion of the roll is brought into contact with the mounting portion, e.g. the blocking element. The axial end face is, in this way, configured to apply a force to the mounting portion, e.g. the blocking element, to move the block arrangement from the blocked to the unblocked condition.

The housing may comprise a lid incorporating a severing mechanism for severing the sheet material.

It will be appreciated that, when the roll of material is not properly loaded in the dispenser housing, operation of the lid, e.g. closure of the lid, may be inhibited. In this way operation of the severing mechanism may be inhibited when the roll of material is not properly loaded in the dispenser housing. In contrast when the roll of material is properly loaded in the dispenser housing, operation of the lid is not inhibited by the roll.

When a user attempts to use an incorrect roll of material with the dispenser, the block arrangement of the mounting portion cannot be unblocked, accordingly movement of the tilting member to the operative position is inhibited. Closure of the lid is therefore also inhibited by the roll since the roll is not properly positioned. This prevents proper operation of the dispenser.

Even if it is possible for an incorrect roll to be positioned in the dispenser such that its first end is supported by the mounting portion when the tilting member is in the loading position, and the second end of the roll is supported by the support portion, due to the angled position of the tilting member, the roll is likely to occupy an angled position with respect to the longitudinal axis of the dispenser. Such angled positioning of the roll may also inhibit closure of the lid, and therefore prevent proper operation of the dispenser.

The mounting portion may further comprise a lock arrangement which is movable between a locked condition and a free condition. The lock arrangement may comprise a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition. When the roll is moved from the disengaged to the engaged condition, the first end portion of the roll may move the lock arrangement into the free condition, thereby permitting rotation of the rotatable element.

The locking element and the rotatable element may be configured for engagement by relative movement of the locking element and the rotatable element towards each other in a direction along the axis of rotation of the rotatable element.

In some embodiments, when the roll is loaded in the housing, the axis of rotation of the rotatable element is provided along the axis of rotation of the roll. In addition, in some embodiments, to load a roll into a dispenser housing, a force is applied in a direction along the longitudinal axis of the roll, towards the mounting portion, to secure the roll in the mounting portion. In this way, axial movement of the roll (i.e. along the axis of rotation of the roll, which is also along the axis of rotation of the rotatable element) to load the roll into the mounting portion can be used to cause the locking element and the rotatable element to disengage from one another, such that the rotatable element is free to rotate.

Since the rotatable element and the locking element are configured for engagement by relative movement of the locking element and the rotatable element towards each other in a direction along the axis of rotation of the rotatable element, movement of the roll can be used to disengage the rotatable element and the locking element. The arrangement does not require translation of the direction of the force applied by the roll into a force in a different direction, e.g. transverse to the longitudinal axis of the roll or transverse to the axis of rotation of the rotatable element, in order to disengage the locking element and rotatable element. In this way, a more robust lock arrangement is provided.

It will be appreciated that, in embodiments comprising both a block arrangement and a lock arrangement, the action of loading the roll of material into the mounting portion can provide two effects: unlocking the lock arrangement to free rotation of the rotatable element, and unblocking the block arrangement to free the tilting member for rotation about its pivot. In other words, a single action by the user results in two effects in the mounting portion.

The block arrangement may comprise a blocking element actuatable by the first end portion of the roll to move the block arrangement from the blocked condition to the unblocked condition. The locking element and the blocking element may be provided by the same component.

The block arrangement may comprise a blocking element which is actuatable by the first end portion of the roll to move the block arrangement from the blocked condition to the unblocked condition. The rotatable element and the blocking element may be provided by the same component.

According to a fifteenth aspect of the invention, there is provided a mounting system for a sheet dispenser having a roll of sheet material and a housing to receive the roll, wherein the mounting system comprises: a first end portion of a roll incorporating a key; and a corresponding mounting portion arranged to support the first end portion of the roll and a support portion arranged to support a second end of the roll; wherein the mounting portion comprises a tilting member pivotally arranged to define an operative position, in which the mounting portion and the support portion are aligned to support a roll in a housing, and a loading position, in which the mounting portion and the support portion are unaligned to inhibit support of a roll in a housing; wherein the mounting portion comprises a block arrangement which is movable between a blocked condition, in which movement of the tilting member from the loading position to the operative position is inhibited, and a unblock condition, in which movement of the tilting member from the loading position to the operative position is permitted; and wherein the mounting portion is arranged such that the first end portion is movable between an engaged condition, in which the key engages the mounting portion, and a disengaged condition, in which the key is disengaged from the mounting portion, such that, when the first end portion of the roll is moved from the disengaged to the engaged condition, the first end portion moves the block arrangement into the unblocked condition, thereby permitting movement of the tilting member from the loading position to the operative position.

According to a sixteenth aspect of the invention, there is provided a sheet dispenser comprising a housing for receiving a roll of sheet material, the roll comprising a first end portion incorporating a key, wherein: the housing comprises a mounting portion arranged to support the first end portion of the roll and a support portion arranged to support a second end of the roll; wherein the mounting portion comprises a tilting member pivotally coupled to the housing to define an operative position, in which the mounting portion and the support portion are aligned to support a roll in the housing, and a loading position, in which the mounting portion and the support portion are unaligned to inhibit support of a roll in the housing; wherein the mounting portion comprises a block arrangement which is movable between a blocked condition, in which movement of the tilting member from the loading position to the operative position is inhibited, and a unblocked condition, in which movement of the tilting member from the loading position to the operative position is permitted; and wherein the mounting portion is arranged such that a roll is movable between an engaged condition, in which the key engages the mounting portion, and a disengaged condition, in which the key is disengaged from the mounting portion, such that, when a roll is moved from the disengaged to the engaged condition, the first end portion of the roll moves the block arrangement into the unblocked condition, thereby permitting movement of the tilting member from the loading position to the operative position.

The mounting portion may further comprise a lock arrangement which is movable between a locked condition and a free condition. The lock arrangement may comprise a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition. When the roll is moved from the disengaged to the engaged condition, the first end portion of the roll may move the lock arrangement into the free condition, thereby permitting rotation of the rotatable element.

The roll may comprise a first end portion having a key, the key comprising one or more depressions or recesses in an axial end face of the first end portion of the roll. The one or more depressions or recesses may be configured to receive one or more corresponding formations provided by a mounting portion of a dispenser housing.

According to a seventeenth aspect of the invention, there is provided a replacement roll of material for use with a sheet dispenser according to the sixteenth aspect of the invention.

The replacement roll of material may comprise one or more mounting formations which are arranged to be supported by the mounting portion of the sheet dispenser when the block arrangement is in the unblocked condition.

According to a eighteenth aspect of the invention, there is provided a sheet dispenser system comprising a sheet dispenser according to the sixteenth aspect of the invention and a replacement roll of material. The replacement roll of material may comprise one or more mounting formations which are arranged to be supported by the mounting portion of the sheet dispenser when the block arrangement is in the unblocked condition.

The replacement roll may comprise one or more mounting formations and the mounting portion of the dispenser may comprise one or more complimentary formations configured to support the one or more mounting formations of the replacement roll. One or more of the formations of the replacement roll may be mounted onto the one or more complimentary formations of the mounting portion of the sheet dispenser.

According to a nineteenth aspect of the invention, there is provided a method of mounting a replacement roll of sheet material into a sheet dispenser according to the sixteenth aspect of the invention, the method comprising the steps of: a) moving a key from the disengaged to the engaged condition such that the block arrangement is moved into the unblocked condition, in which movement of the tilting member from the loading position to the operative position is permitted; and b) mounting a first end of the replacement roll into the mounting portion of the dispenser.

According to a twentieth aspect of the invention, there is provided a method of removing a roll of sheet material from a sheet dispenser according to the sixteenth aspect of the invention, wherein the mounting portion of the sheet dispenser comprises a biasing mechanism arranged to bias the tilting member towards the loading position, the method comprising the steps of: a) dismounting a roll of sheet material from the mounting portion of the housing; and b) releasing the tilting member for movement, such that the tilting member is moved from the operative position to the loading position under the biasing action of the biasing mechanism.

According to an twenty-first aspect of the invention, there is provided a method of removing a roll of sheet material from a sheet dispenser according to the sixteenth aspect of the invention, wherein the mounting portion of the sheet dispenser comprises a biasing mechanism arranged to bias the block arrangement to the blocked condition, comprising the steps of: a) dismounting a roll of sheet material from the mounting portion of the housing; and b) releasing the block arrangement for movement, such that the block arrangement is moved, under the biasing action of the biasing mechanism, to the blocked condition in which movement of the tilting member from the loading position to the operative position is inhibited.

According to a twenty-second aspect of the invention, there is provided a replacement roll of material for use with a sheet dispenser according to the sixteenth aspect of the invention, wherein the replacement roll of material comprises one or more mounting formations which are arranged to be supported by the mounting portion of the sheet dispenser when the block arrangement is in the unblocked condition and/or when the lock arrangement is in the free condition.

According to a twenty-third aspect of the invention, there is provided a sheet dispenser system comprising a sheet dispenser according to the sixteenth aspect of the invention and a replacement roll of material, wherein the replacement roll of material comprises one or more mounting formations which are arranged to be supported by the mounting portion of the sheet dispenser when the block arrangement is in the unblocked configuration and/or when the lock arrangement is in the free condition.

According to a twenty-fourth aspect of the invention, there is provided a method of mounting a replacement roll of sheet material into a sheet dispenser according to the sixteenth aspect of the invention, comprising the steps of: a) moving a key from the disengaged to the engaged condition such that the block arrangement is moved into the unblocked condition, in which movement of the tilting member from the loading position to the operative position is permitted; and/or b) moving a key from the disengaged to the engaged condition such that the lock arrangement is moved into the free condition, in which rotation of the rotatable element is permitted; and mounting a first end of the replacement roll into the mounting portion of the dispenser.

According to an twenty-fifth aspect of the invention, there is provided a method of removing a roll of sheet material from a sheet dispenser according to the sixteenth aspect of the invention, wherein the mounting portion of the sheet dispenser comprises a biasing mechanism arranged to bias the lock arrangement into the locked condition; the method comprising the steps of: a) dismounting a roll of sheet material from the mounting portion of the housing; and b) releasing the lock arrangement for movement, such that the lock arrangement is moved, under the biasing action of the biasing mechanism, to the locked condition in which rotation of the rotatable element is inhibited.

According to a twenty-sixth aspect of the invention, there is provided a roll of material for use with a sheet dispenser disclosed herein, wherein the roll comprises a first end portion having a key, the key comprising one or more depressions or recesses in an axial end face of the first end portion of the roll, wherein the one or more depressions or recesses are configured to receive one or more corresponding formations provided by a mounting portion of a dispenser housing.

According to a twenty-seventh aspect of the invention, there is provided a use of a replacement roll of sheet material with a sheet dispenser disclosed, wherein the replacement roll comprises one or more mounting formations and the mounting portion of the dispenser comprises one or more complimentary formations configured to support the one or more mounting formations of the replacement roll, and wherein the use comprises mounting the one or more formations of the replacement roll onto the one or more complimentary formations of the mounting portion of the sheet dispenser.

Of course, it will be appreciated that the optional features disclosed herein may apply to any aspect of the invention. All possible combinations are not recited herein for the sake of brevity.

BRIEF DESCRIPTION OF THE DRAWINGS

Embodiments of the present disclosure will now be described, by way of example only, with reference to the accompanying drawings, in which:

FIGS. 8*a*-8*c* are shown as cross-sectional views through line A-A of FIG. 3*a* and FIGS. 8*d* and 8*e* are shown as cross-sectional views through line B-B of FIG. 3*a;*

DETAILED DESCRIPTION OF EMBODIMENT(S)

Figure 1:
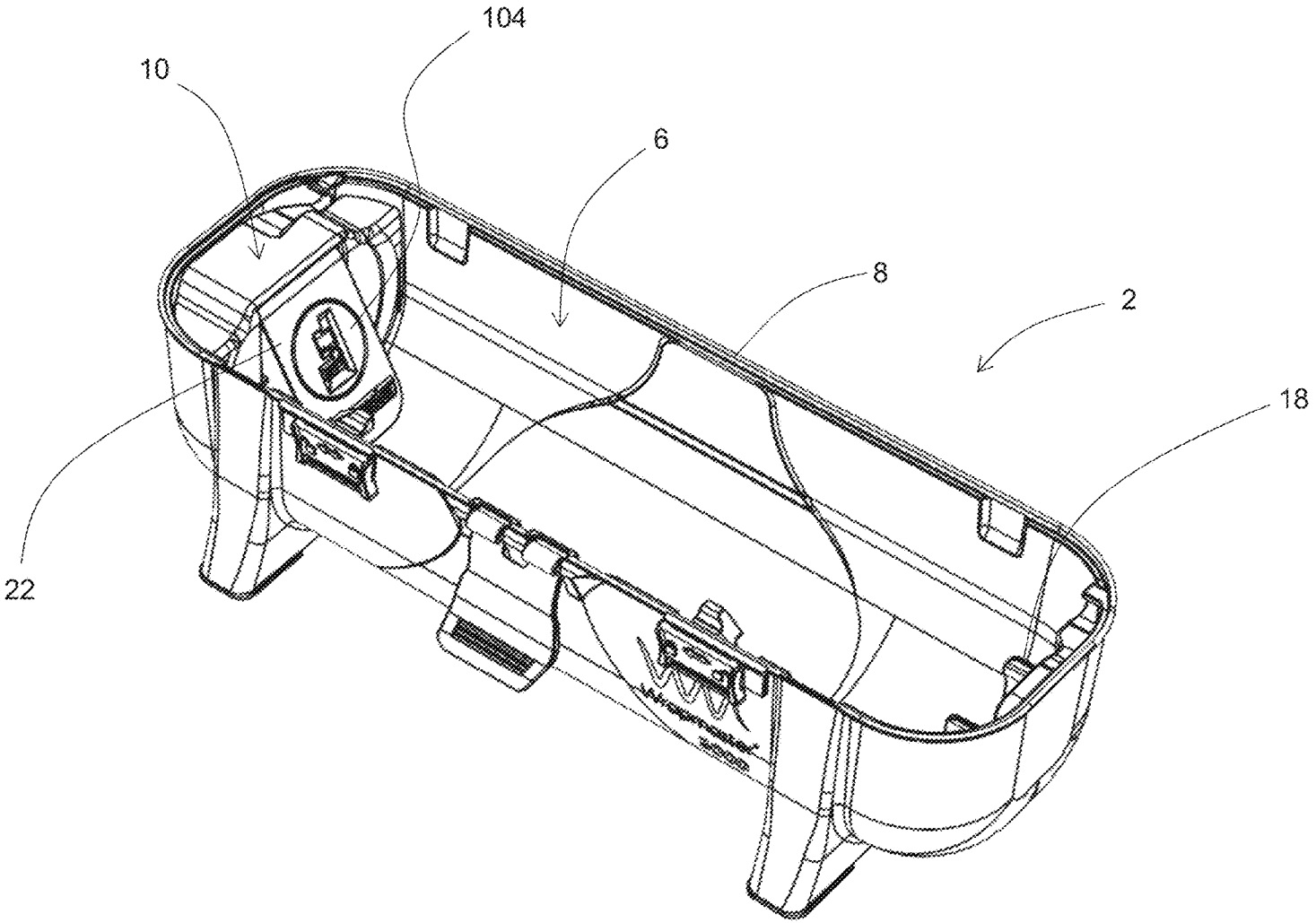
FIG. 1 shows a perspective view of a sheet dispenser in accordance with the present disclosure.
Figure 2:
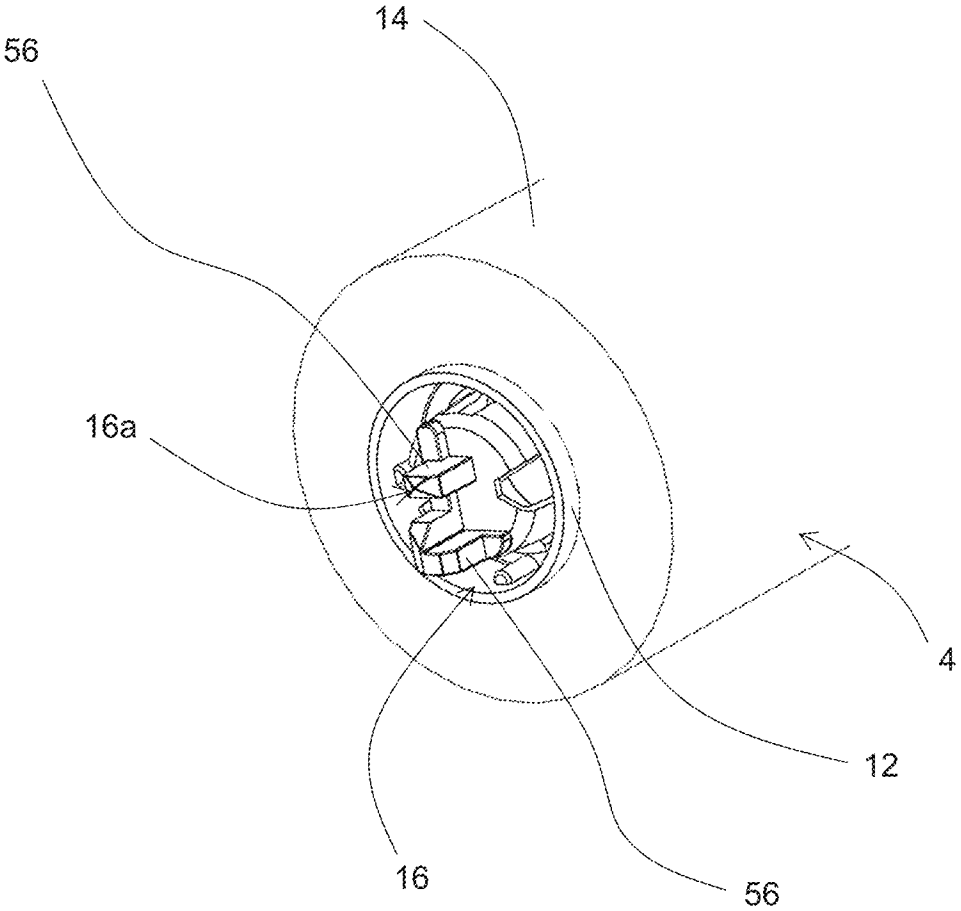
FIG. 2 shows a perspective view of a first end of a roll for use with the dispenser of FIG. 1.

With reference to FIGS. 1 and 2, a sheet dispenser 2 is provided for use with a roll of sheet material 4. The dispenser 2 has a housing 6 for receiving a correct roll of sheet material 4. The housing 6 is substantially rectangular in shape to form an enclosure for the roll 4, and has an opening 8 through which the roll 4 can be positioned in and removed from the housing 6 and through which sheet material from the roll 4 can be dispensed.

The dispenser 2 may further comprise a lid (not shown) incorporating a severing mechanism for severing sheet material 14 from the roll 4 as it is dispensed from the dispenser 2. Accordingly it will be appreciated that correct loading of a roll 4 in the housing 6 is required in order for the dispenser 2 to operate correctly.

As shown in FIG. 2, the roll 4 includes a body 12. Sheet material 14, for example in the form of food wrap, is wound around the roll body 12. The roll 4 of sheet material includes a first end portion 16 incorporating a key 16*a*, and a second end 20 (shown in FIG. 8*f*).

Figure 8A:
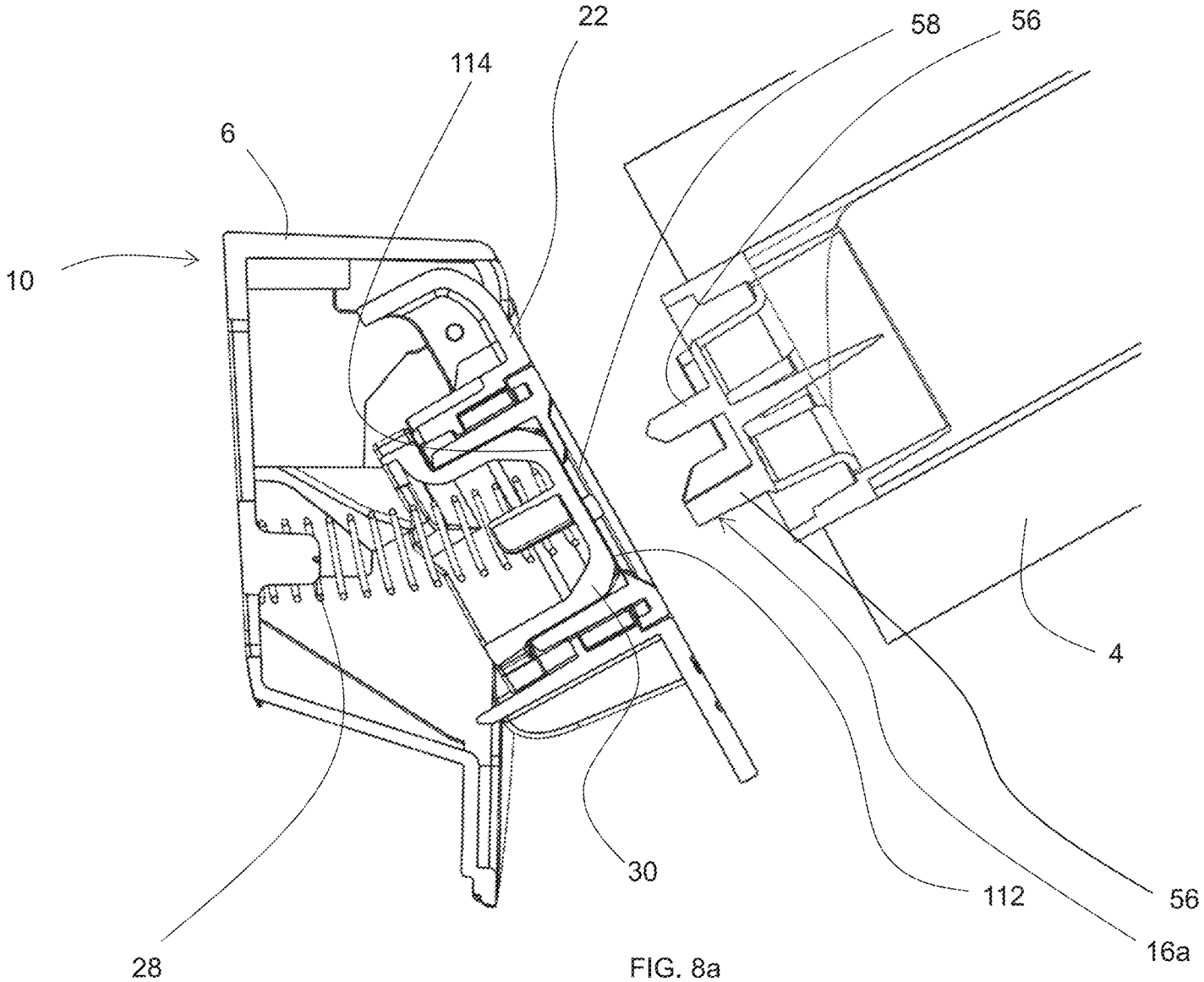
FIGS. 8*a* to 8*e* show the operation of the mounting portion of FIG. 3*a* as a roll is loaded into the dispenser of FIG. 1.
Figure 8B:
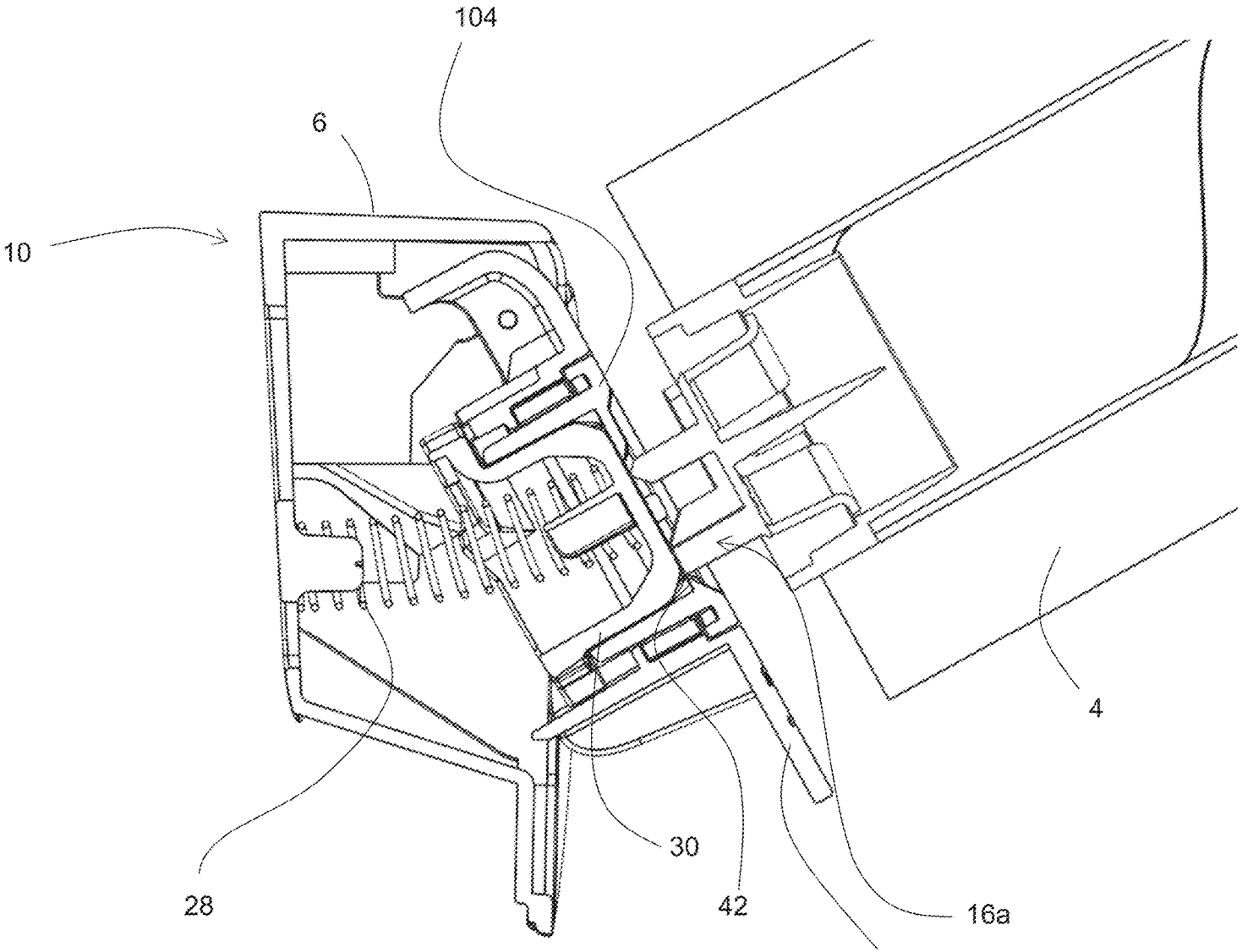
Figure 8C:
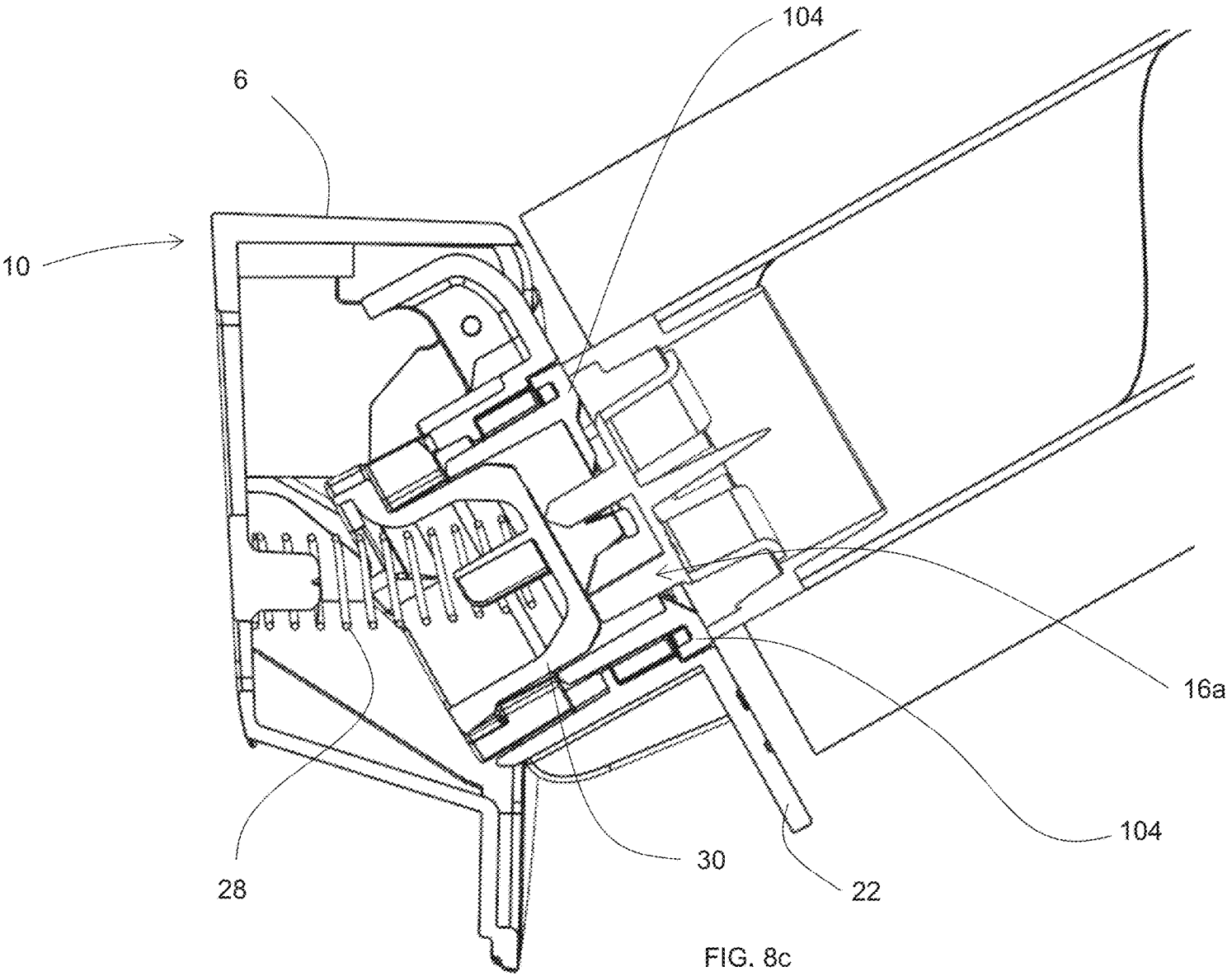
Figure 8D:
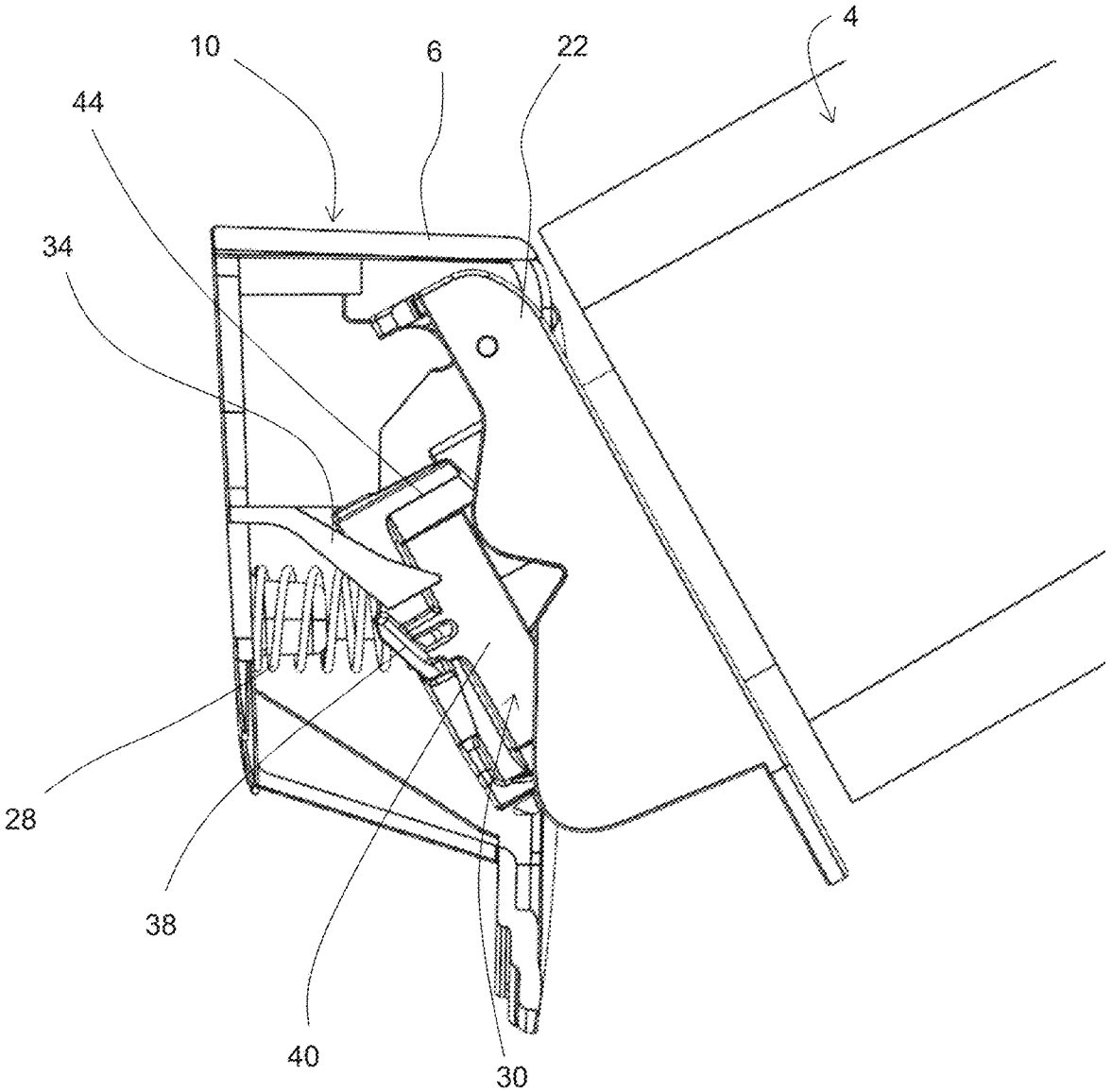

The dispenser housing 6 includes a mounting portion 10 arranged to support the first end portion 16 of the roll 4. The housing 6 also includes a support portion 18 which is arranged to support the second end 20 of the roll 4, as is shown in FIG. 8*f*.

Figure 3A:
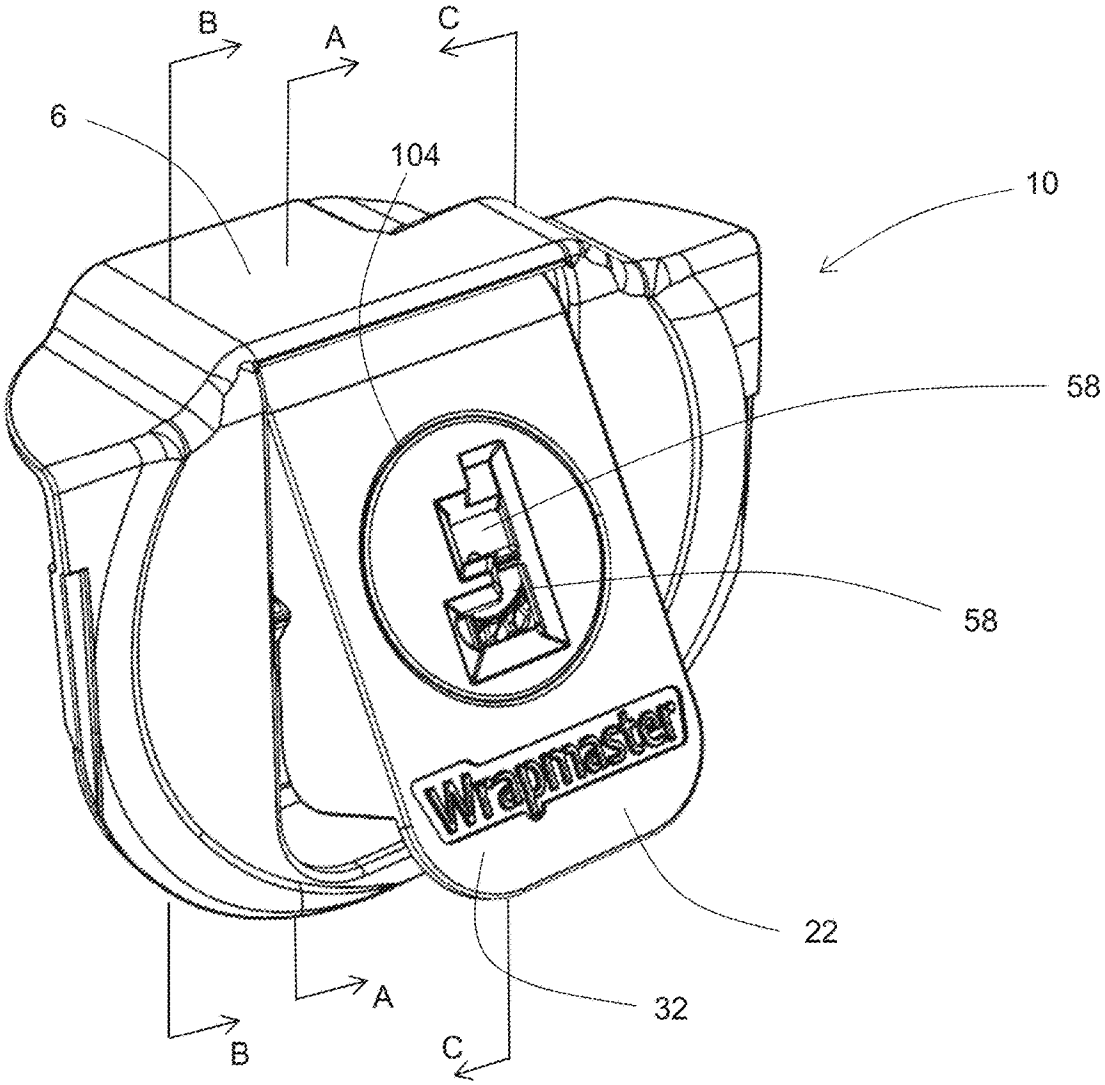
FIG. 3*a* shows a close-up view of a mounting portion of the dispenser of FIG. 1, when the mounting portion is in the loading position.
Figure 3B:
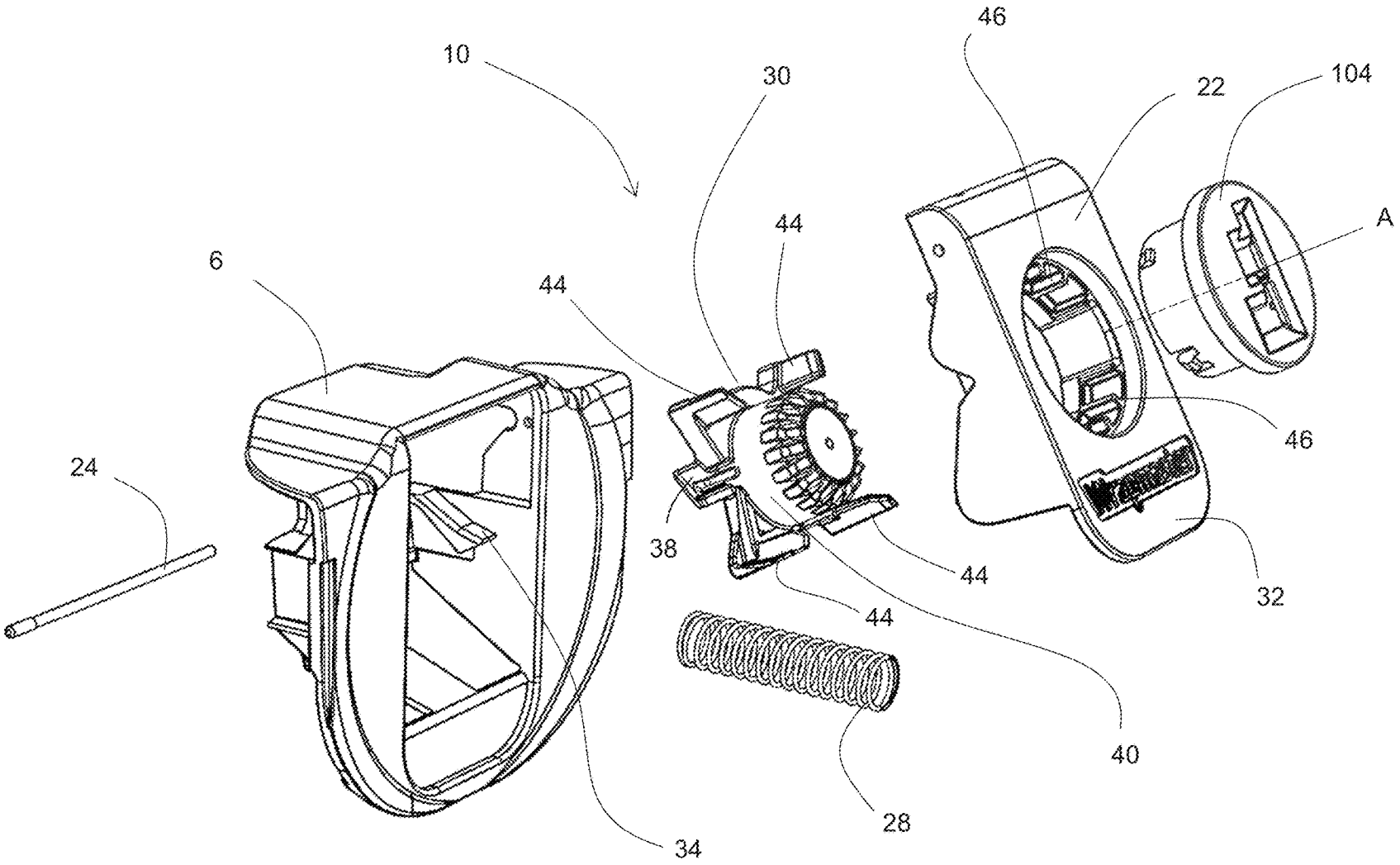
FIG. 3*b* shows an exploded view of the mounting portion of FIG. 3*a;*
Figure 3C:
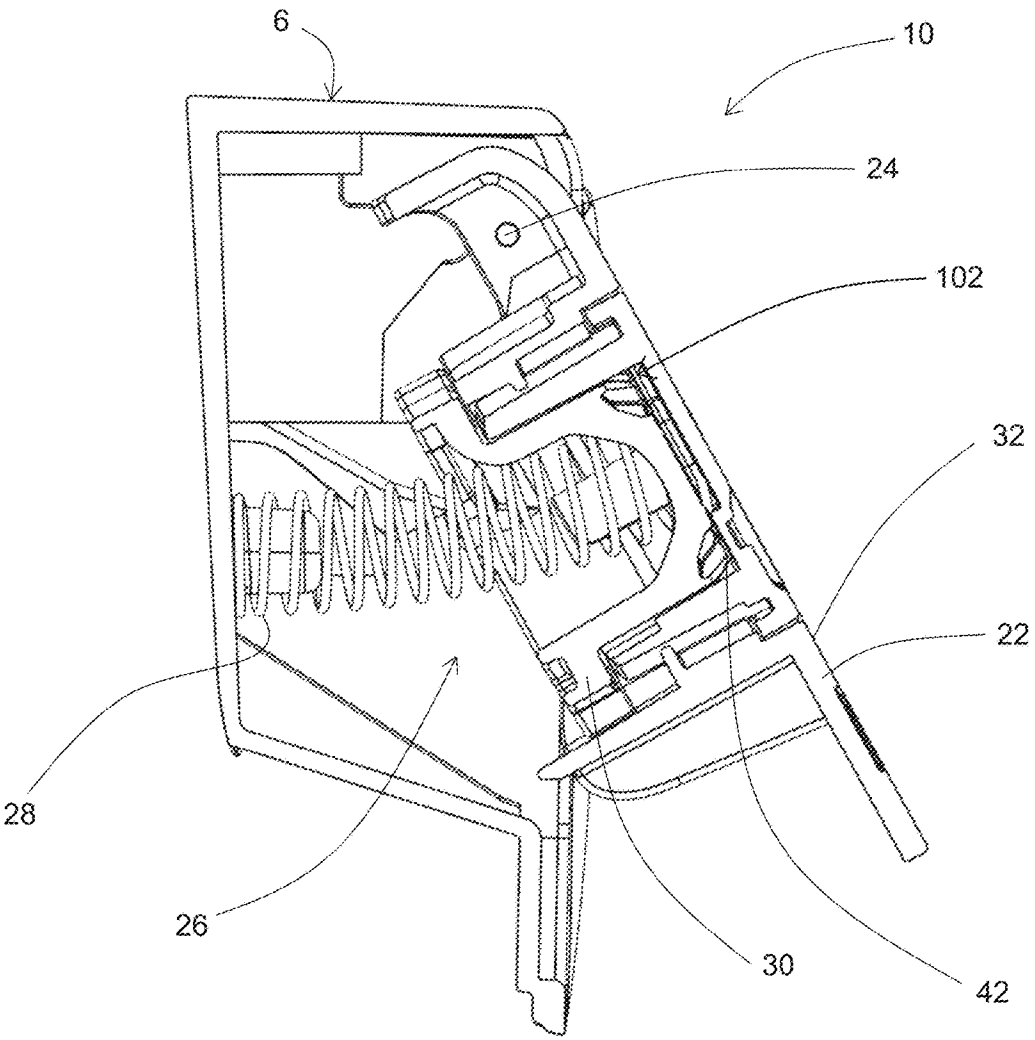
FIG. 3*c* shows a cross-section view of the mounting portion of FIG. 3*a* through line A-A, when the mounting portion is in the loading position.

With reference to FIGS. 3*a*, 3*b* and 3*c*, the mounting portion 10 includes a tilting member 22 pivotally coupled to the housing 6. As shown in FIG. 3*b*, the tilting member 22 is pivotally coupled to the housing 6 via a pivot pin 24. The tilting member 22 is configured to define an operative position and a loading position.

Figure 8E:
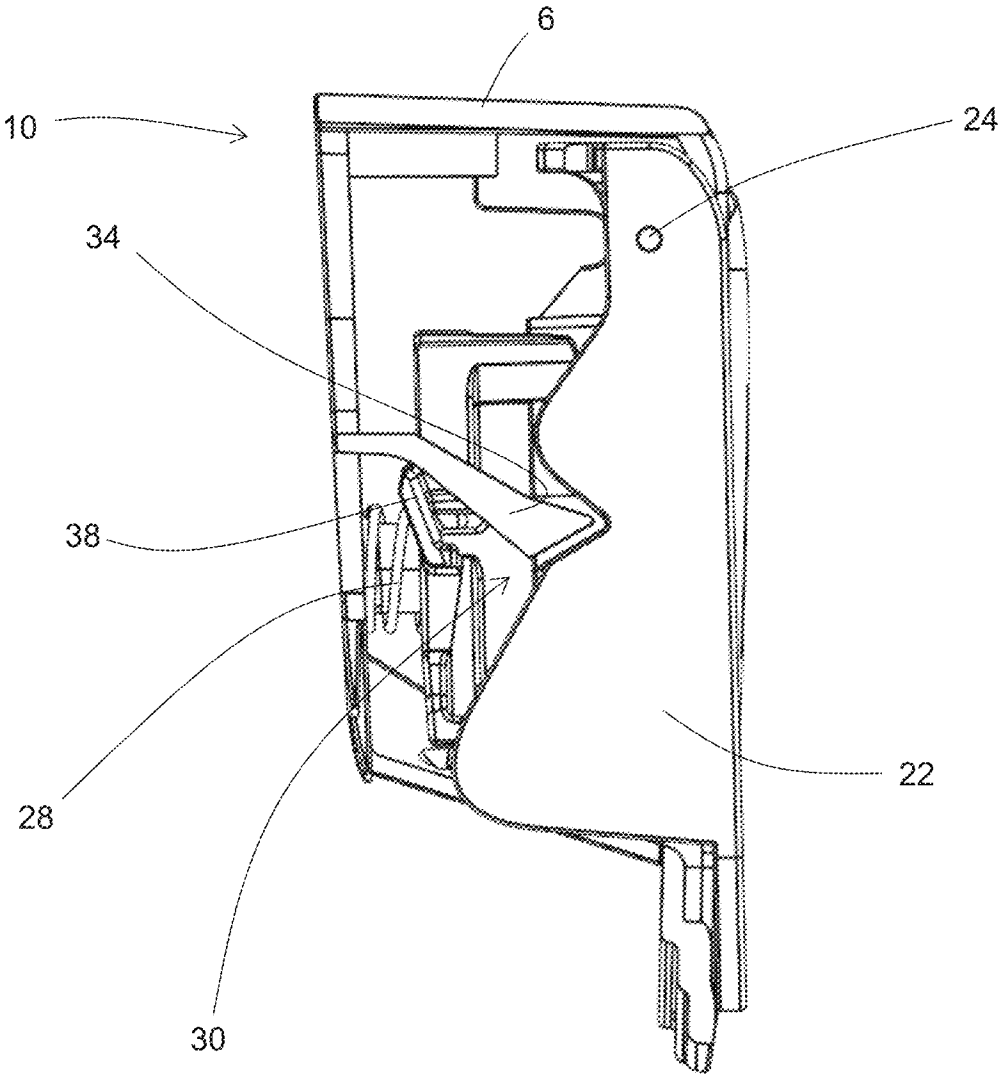
Figure 8F:
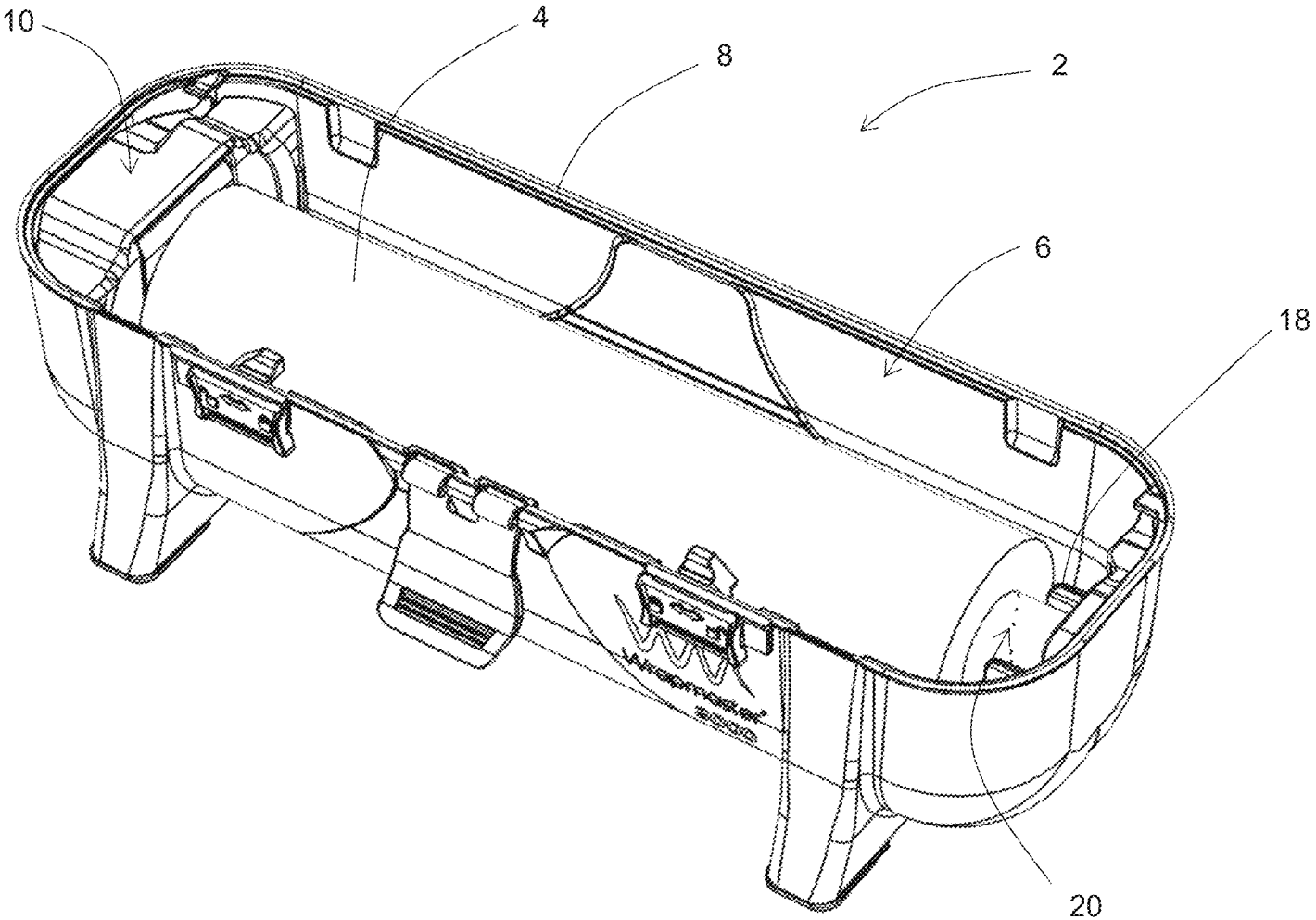
FIG. 8*f* shows the dispenser of FIG. 1 in which a roll has been loaded.

The operative position is shown in FIG. 8*e*. When the tilting member 22 is in the operative position, the mounting portion 10 and the support portion 18 are coaxially aligned such that the roll 4 can be supported in housing 6, as shown in FIG. 8*f*. In other words, in the operative position, the roll 4 can be mounted in the housing 6 such that sheet material 14 can be dispensed from the roll 4.

The loading position is shown in FIG. 8*a*. When the tilting member 22 is in the loading position the mounting portion 10 and the support portion 18 are not in alignment, as can be seen in FIG. 1. Accordingly, support of the roll 4 in the housing 6 is inhibited in the loading position.

The tilting member 22 of the mounting portion 10 is arranged to support the first end portion 16 of the roll 4, as is illustrated in FIGS. 8*a* to 8*e*.

Figure 9A:
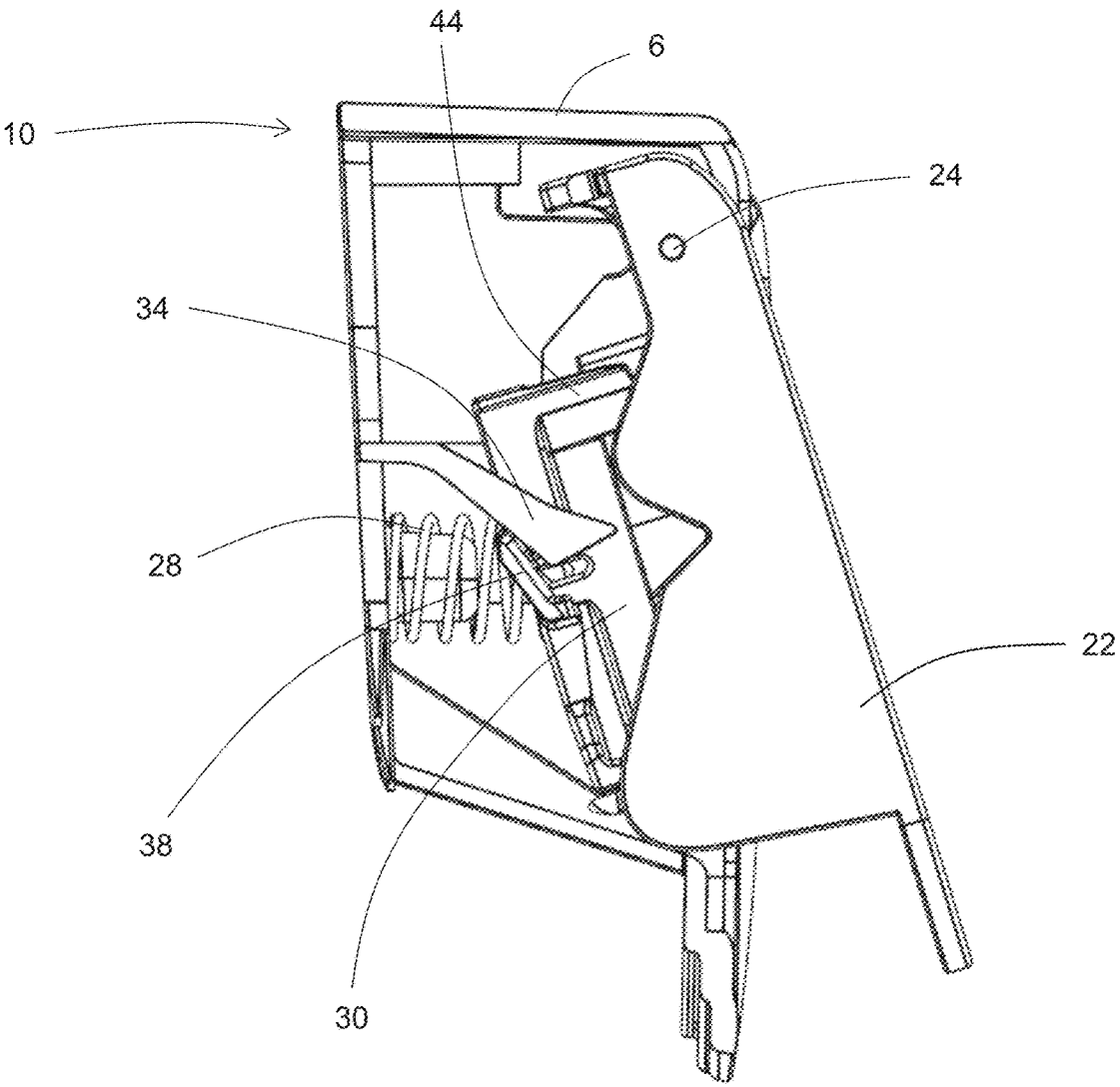
FIGS. 9*a* and 9*b* show the mounting portion of FIG. 3*a* through line B-B returning to the loading position from the operative position.

With reference to FIG. 3*c*, the mounting portion 10 includes a block arrangement 26 which is movable between a blocked condition and an unblocked condition. In the blocked condition, movement of the tilting member 22 from the loading position (as shown in FIG. 3*a*) to the operative position (as shown in FIG. 9*a*) is inhibited. In contrast, in the unblocked condition, movement of the tilting member 22 from the loading position to the operative position is permitted.

The mounting portion 10 is arranged such that the roll 4 is movable between an engaged condition and a disengaged condition. In the engaged condition, the key 16*a* of the first end portion 16 engages the mounting portion 10, as is illustrated in FIG. 8*c*. In the disengaged condition, the key 16*a* is disengaged from the mounting portion 10, as is illustrated in FIG. 8*a*. The mounting portion 10 is arranged such that, when the roll 4 is moved from the disengaged to the engaged condition, the key 16*a* moves the block arrangement 26 into the unblocked condition, in which movement of the tilting member 22 from the loading position to the operative position is permitted.

Turning again to FIG. 1 and FIG. 8*f*, alignment of the mounting portion 10 and the support portion 18 comprises alignment along a longitudinal axis of the housing 6. In other words, the mounting portion 10 and the support portion 18 are aligned along a longitudinal axis of the roll 4, when the roll 4 is loaded in the dispenser 2.

The mounting portion 10 includes a biasing mechanism, for example a compression spring 28, which is configured to bias the block arrangement 26 into the blocked condition. This is illustrated in FIG. 3*c*.

The block arrangement 26 includes a blocking element 30 which is configured to be actuated by the key 16*a* of the first end portion 16 of the roll 4 to move the block arrangement 26 from the blocked condition to the unblocked condition.

The tilting member 22 is configured for rotation about pivot pin 24 to move the tilting member 22 from its loading condition to its operative condition. Accordingly the tilting member 22 moves through an arc of rotation as it moves from the loading condition to the operative condition. In the illustrated embodiments, actuation of the blocking element 30 by the key 16*a* includes movement of the blocking element 30 in a direction which is substantially along a tangent of the arc of rotation of the tilting member 22 as it rotates between the loading position and the operative position.

With reference to FIGS. 3*a*, 3*b* and 3*c*, the tilting member 22 includes a surface 32 which extends in a direction substantially orthogonal to the longitudinal axis of the housing when the tilting member is in the operative position. It will therefore be appreciated that actuation of the blocking element 30 by the key 16*a* involves movement of the blocking element 30 in a direction which is substantially perpendicular to the surface 32 of the tilting member 22.

Figure 4A:
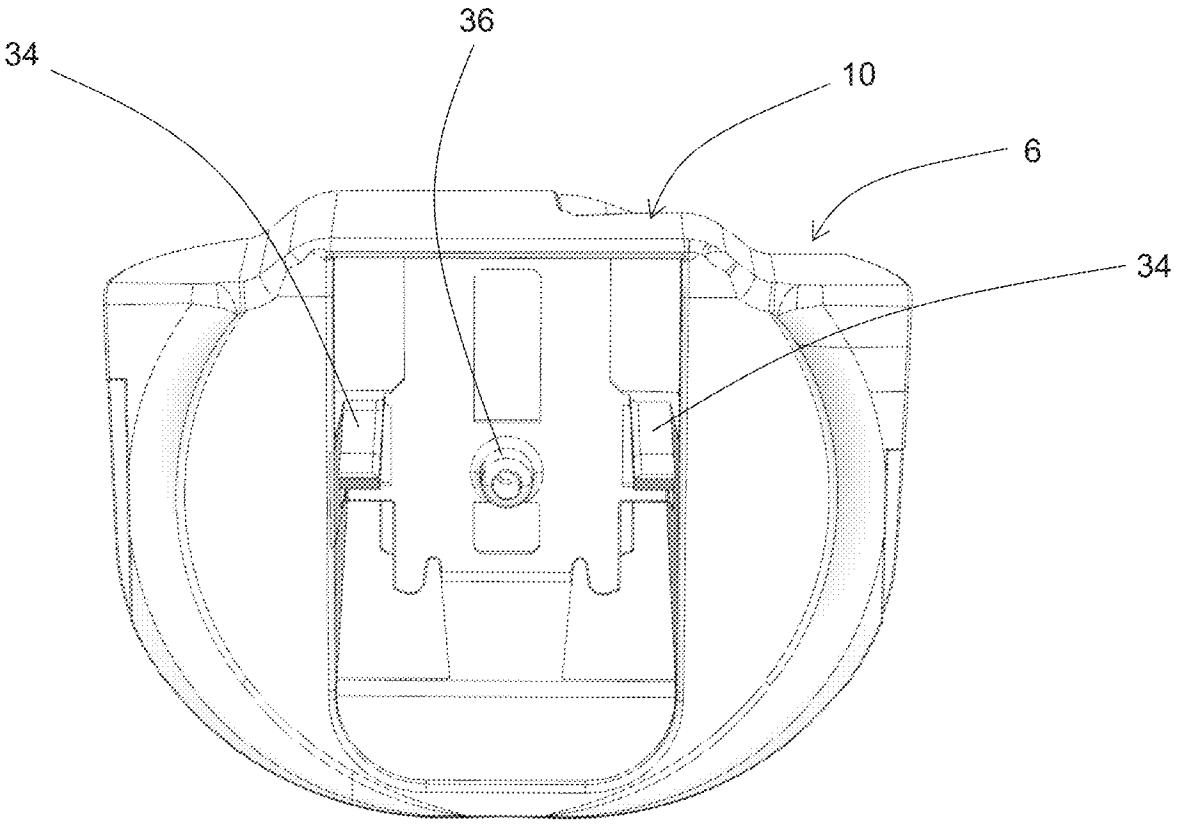
FIGS. 4*a* and 4*b* show a close up views of a portion of the mounting portion of FIG. 3*a;*
Figure 4B:
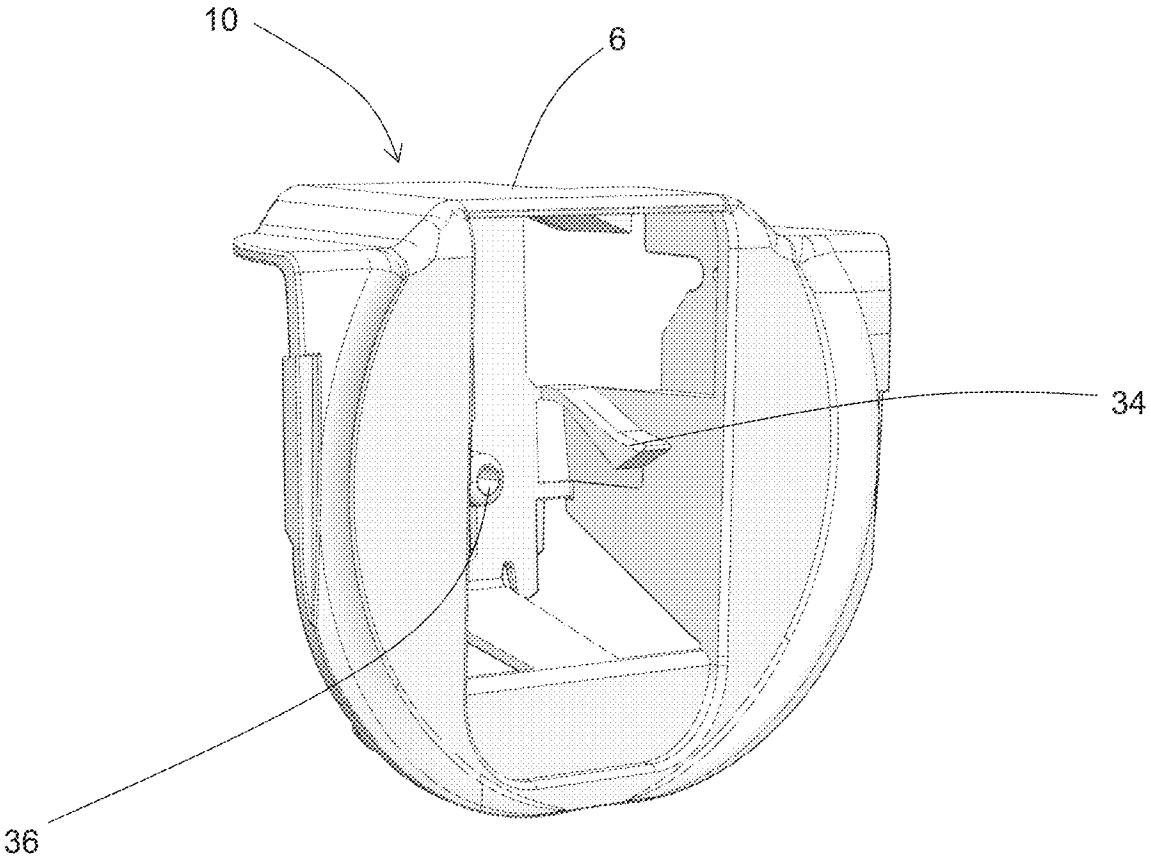
Figure 5:
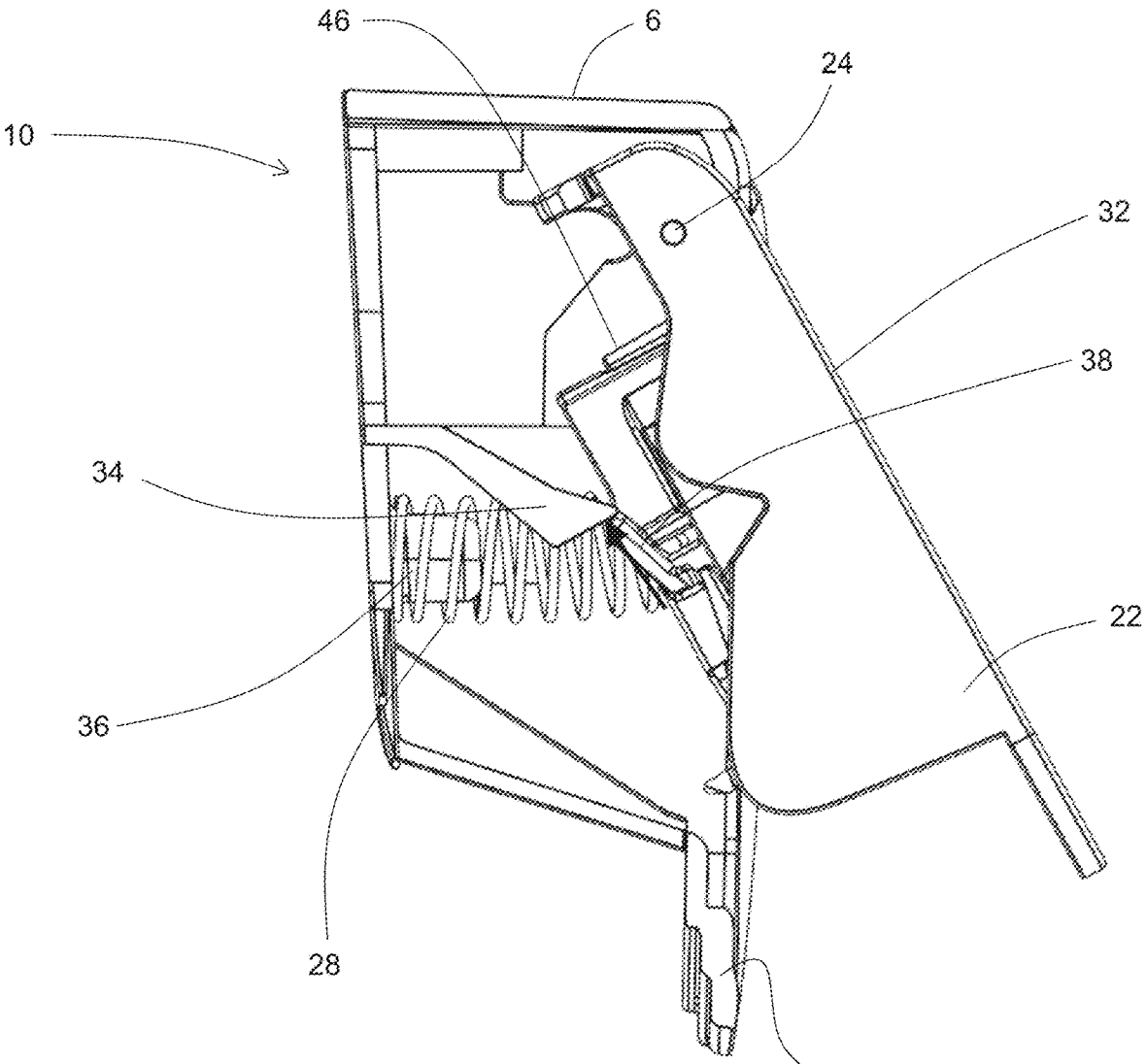
FIG. 5 shows a cross-section view of the mounting portion of FIG. 3*a* through line B-B, in which the block arrangement can be seen.

The block arrangement 26 further comprises a blocking formation 34, as shown in detail in FIGS. 4*a*, 4*b* and 5. As illustrated in FIG. 5, the blocking element 30 is configured to engage the blocking formation 34. This engagement inhibits movement of the tilting member 22 about its pivot axis, i.e. about the pivot pin 24. Accordingly movement of the tilting member 22 from the loading position to the operative position is inhibited.

As can be seen in FIGS. 8*b* and 8*c*, the blocking element 30 is configured for actuation by the key 16*a* to move the block arrangement 26 from the blocked condition to the unblocked condition. Actuation of the blocking element 30 involves movement of the blocking element 30 out of engagement with the blocking formation 34 to permit rotation of the tilting member about the pivot point 24. When the blocking formation 34 and blocking element 30 are engaged, this engagement acts as a stop against rotation of the tilting member 22 from the loading condition to the operative condition.

The mounting portion 10 also includes a compression spring locator 36, on which the compression spring 28 is mounted to locate the compression spring 28 in the optimum position for biasing the blocking element 30 into engagement with the blocking formation 34.

The compression spring 28 is positioned to engage the blocking element 30, as shown in FIG. 3*c* and FIG. 8*b*, so to bias the blocking element 30 into engagement with a rear surface 42 of the tilting member 22. The compression spring 28 also acts to bias the blocking element into engagement with the blocking formation 34 to retain the tilting member 22 in the loading position. Put another way, the block arrangement 26 is biased to the blocked configuration in which movement of the tilting member 22 between the loading condition and the operative condition is inhibited or prevented.

As illustrated in FIGS. 4*a* and 4*b*, the blocking formation 34 comprises a pair of stop portions 34 which are positioned to engage the blocking element 30 when the block arrangement 26 is in the blocked condition.

The blocking element 30 comprises a pair of wing portions 38 (see FIG. 3*b*, FIG. 5 and FIG. 7*b*) extending from a body 40 of the blocking element 30. Each of the wing portions 38 is configured for engagement with a respective one of the stop portions 34 to inhibit movement of the blocking element 30. As is shown in FIG. 5, should a force be applied to the tilting member 22 in an attempt to move the tilting member 22 from the loading position to the operative position, the wing portions 38 of the blocking element 30 abut the blocking formation 34 of the mounting portion 10, as illustrated by the arrow in FIG. 5. In this way, movement of the tilting member 22 from the loading position to the operative position is inhibited by the blocking arrangement 26.

It will be appreciated that any suitable number of stop portions 34 and respective wing portions 34 may be used, for example, 1, 2, 3, 4, 5, 6 or more.

Figure 7B:
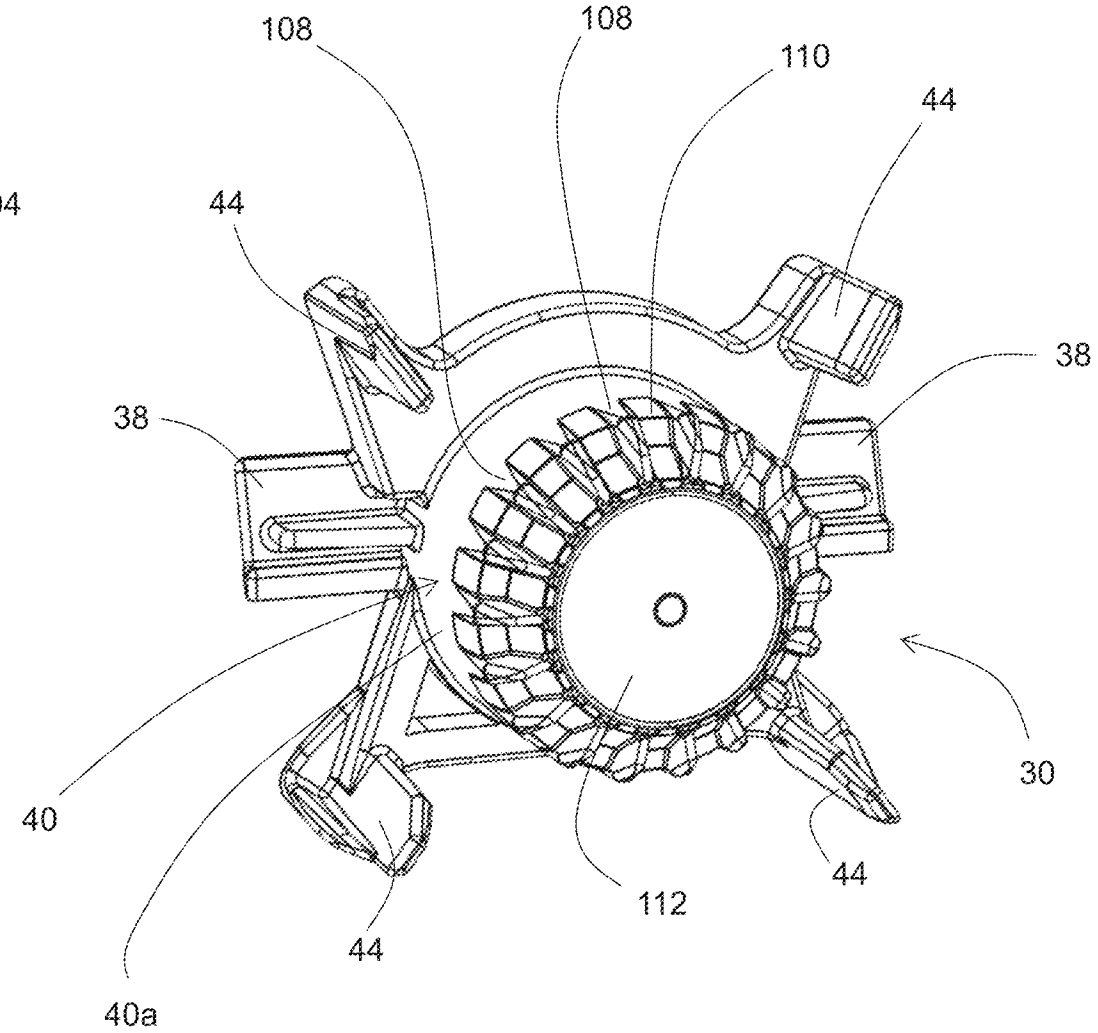
FIG. 7*b* shows a locking element/blocking element of the mounting portion of FIG. 3*a;*

The mounting portion 10 comprises guide elements 44, 46 which act to guide the movement of the blocking element 30 as it is moved out of and in to engagement with the blocking formations 34. As is shown in FIGS. 5 and 7*b* the guide elements 44, 46 comprise a series of guide elements 44 extending from the body 40 of the blocking mechanism 30. These guide elements 44 are arranged to correspond to guide elements 46 (as shown in FIG. 5), which are provided as extensions from the tilting member 22 of the mounting portion 10, for example, extensions from the rear surface 42 of the tilting member 22.

As the blocking member 30 is moved to unblock the block arrangement 26, the guide members 44 of the blocking mechanism 30 slide against the guide elements 46 of the tilting member 22 to facilitate the correct positioning of the blocking element 30 with respect to the blocking formations 34. In this way, engagement and disengagement of the blocking elements 30 and the blocking formations 34 is facilitated, thereby providing a more robust block arrangement 26.

Figure 6:
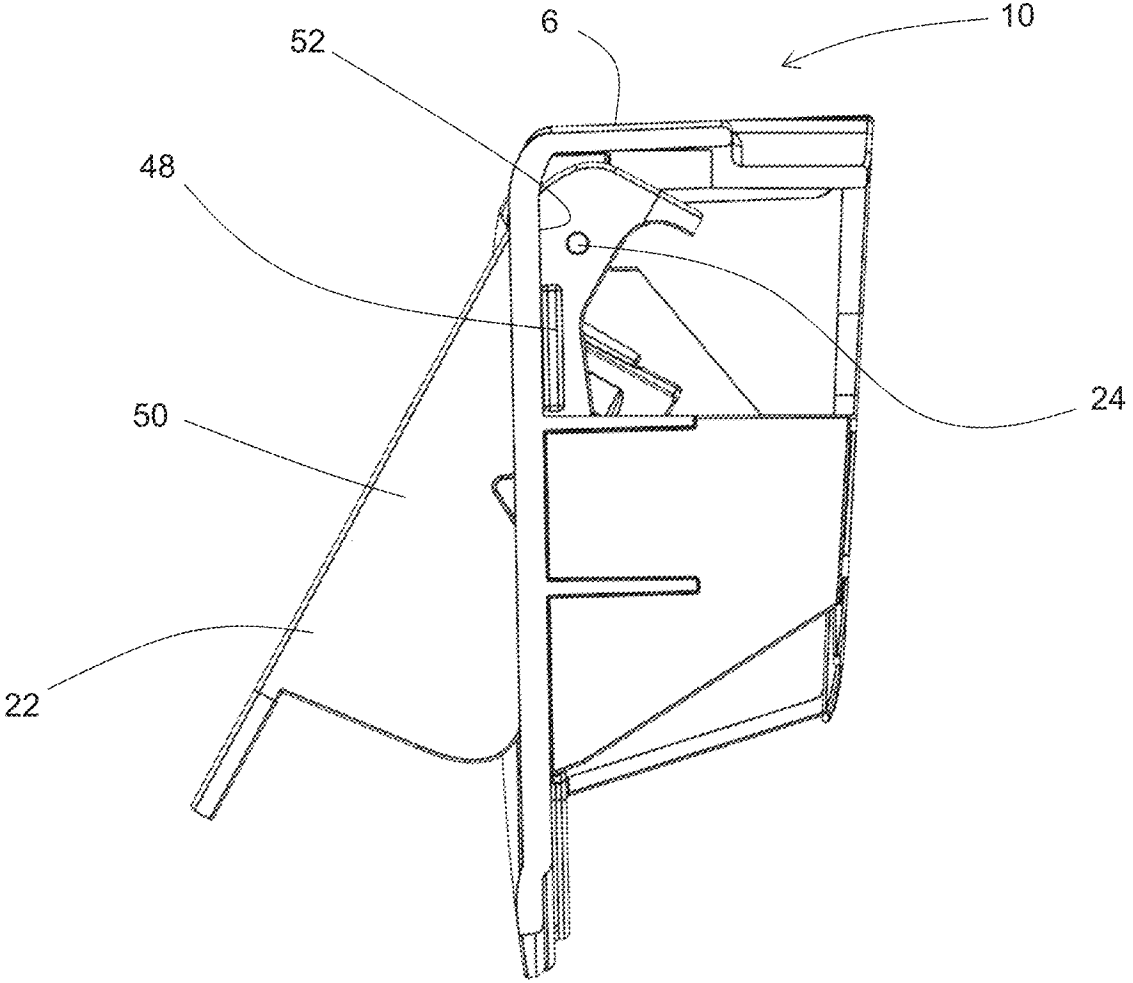
FIG. 6 shows a cross-sectional side view of the mounting portion of FIG. 3*a* through line C-C.

With reference to FIG. 6, the mounting portion 10 comprises one or more stop elements 48. These stop elements 48 are arranged to limit the angle through which the tilting portion 22 can rotate as it travels between the operative position and the loading position. In the illustrated embodiment, the mounting portion 10 comprises a single stop element 48, which extends from a side surface 50 of the tilting member 22 to engage a rear surface 52 of the housing 6. It will be appreciated that any number of stop elements 48 may be used, for example 2, 3, 4 or more stop elements may be used to set the angle through which the tilting portion can rotate.

With reference to FIG. 5, the housing 6 also comprises a lip 54 against which the tilting member 22 is configured to rest when the tilting member 22 is in the operative position. The position of this lip 54 serves to retain the tilting member 22 at the correct angle required for the roll to be supported in the housing 6 when the roll 4 is in use in dispenser 2.

Turning to FIG. 2, the key 16*a* comprises one or more projections 56. Corresponding keyholes 58, as shown in FIG. 3*a*, are defined by the mounting portion 10. The keyholes 58 are configured to receive the projection(s) of the key 16*a* to support one end of the roll 4. It will be appreciated that a number of projections and corresponding keyholes may be used, for example a single projection and corresponding keyhole may be used. Alternatively 2, 3, 4 or more projections and corresponding keyholes may be used. In the illustrated embodiments, the tilting member 22 comprises the keyholes 58.

As can be seen from FIG. 3*a*, the keyholes 58 are provided in the surface 32 of the tilting member 22. In the embodiment illustrated in FIG. 3*a*, the keyholes 58 are provided in a rotatable member 104, which will be described in further detail below.

In addition to the features outlined above, the mounting portion 10 of the illustrated embodiment also comprises a lock arrangement 102 which is movable between a locked condition and a free condition. The lock arrangement 102 comprises a rotatable element 104 which is arranged for rotation about an axis A.

The lock arrangement 102 comprises a locking element, which in the embodiment illustrated in FIGS. 1 to 9*b* is provided by the blocking element 30. It will be appreciated that in alternative embodiments the blocking element of the block arrangement 26 and the locking element of the lock arrangement 102 may be provided by separate components.

The locking element 30 is configured for engagement with the rotatable element 104 to inhibit rotation of the rotatable element 104. In this way, when the locking element 30 and the rotatable element 104 are engaged, the lock arrangement 102 occupies the locked condition. When the locking element 30 and the rotatable element 104 are disengaged, the lock arrangement 102 occupies the free condition.

The locking element 30 and the rotatable element 104 are arranged for engagement by relative movement of the locking element 30 towards the rotatable element 104 in a direction along the axis of rotation A of the rotatable element 104. In other words, as the rotatable element 104 and the locking element 30 are brought towards each other, in a direction along the axis of rotation A of the rotatable element 104, the locking element 30 and the rotatable element 104 are brought into engagement with one another. In this way the lock arrangement 102 occupies the locked condition.

The mounting portion 10 comprises a biasing mechanism arranged to bias the lock arrangement 102 into the locked condition, in which rotation of the rotatable element 104 is inhibited. The biasing mechanism may be the same as that used in the block arrangement, i.e. the compression spring 28. Alternatively, separate biasing mechanisms can be used for the block arrangement 26 and the lock arrangement 102.

The biasing mechanism 28 is arranged to bias the locking element 30 into engagement with the rotatable element 104.

The mounting portion 10 is configured such that, when the rotatable element 104 is free to rotate, rotation of the roll 4 in the housing 6 is permitted. In other words, when the lock arrangement 102 is in the free condition, rotation of the roll 4 in the housing is permitted. In the illustrated embodiments, the rotatable element 104 is arranged to support the first end portion 16 of the roll 4. This is illustrated in FIG. 8*c*, for example.

In some embodiments, when the lock arrangement 102 is in the free condition, the action of the compression spring 28 biases the locking element 30 towards the rotatable element 104 such that resistance to the rotation of the rotatable element 104 is provided.

Figure 7A:
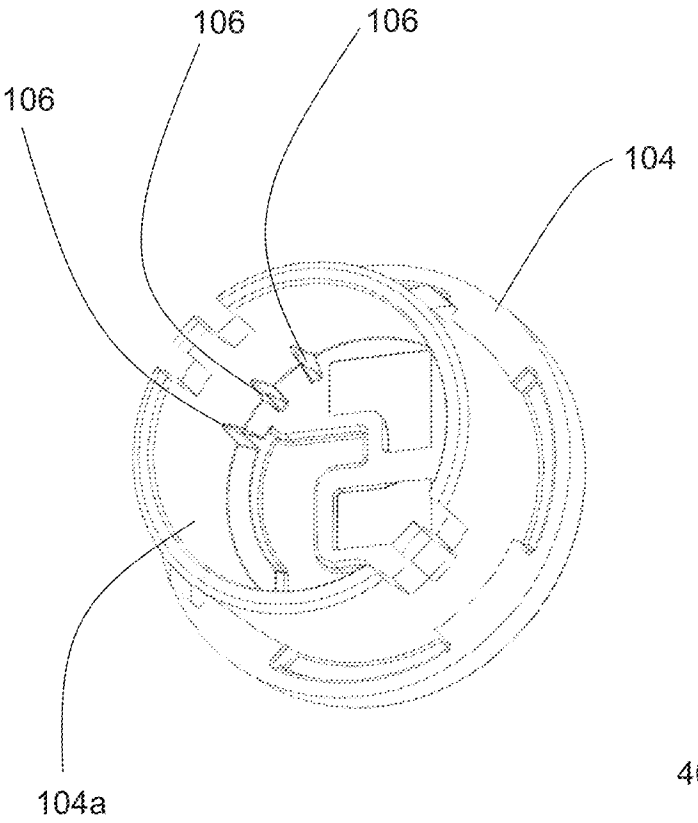
FIG. 7*a* shows a rotatable portion of the mounting portion of FIG. 3*a;*

For example, with reference to FIGS. 7*a* and 7*b*, a side portion 40*a* of the body 40 of the locking element 30 may be biased into contact with an inner side surface 104*a* of the rotatable element 104, such that friction between the side portion 40*a* and the inner side surface 104*a* results in resistance to the rotation of the rotatable element 104. This can be beneficial in providing tactile feedback to a user and also to prevent the free end of the sheet material being retracted into the dispenser due to undesirable rotation of the rotatable element 104.

Therefore the selected spring rate of the compression spring 28 is important in ensuring appropriate rotation of the rotatable element 104 when in use.

In the embodiment illustrated in FIGS. 1 to 9*b*, the tilting member 22 includes the rotatable element 104. As can be seen in FIG. 3*a*, the rotatable element is provided in the surface 32 of the tilting member.

The locking element 30 is fixed against rotation about the axis A. The arrangement of the guide elements 44, 46 provided on the locking mechanism 30 and the tilting member 22 serve to inhibit rotation of the locking member 30. It will be appreciated that the guide elements 46 of the tilting member 22 may alternatively or additionally be provided by the mounting portion 10. Further, the interaction of the locking formations 34 of the mounting portion 10 and the wing portions 38 of the locking element 30 also interact to inhibit rotation of the locking member 30. The tilting member 22 and or the housing 6 can be shaped such that rotation of the locking element 30 is inhibited. It will be appreciated by those skilled in the art that any suitable means of inhibiting rotation of the locking element 30 may be used.

The locking element 30 and the rotatable element 104 comprise a projection 106 and a corresponding recess 108, which are configured for engagement upon relative movement of the locking element 30 towards the rotatable element 104 in a direction along the axis of rotation A of the rotatable element 104. In this way, when the projection 106 engages the corresponding recess 108, rotation of the rotatable element 104 is inhibited. Since the locking element 30 is fixed against rotation about the axis A, when the rotatable element 104 is engaged with the locking element 30 the rotatable element 104 is therefore also locked against rotation about axis A.

The lock arrangement 102 comprises a plurality of configurations which correspond to the locked condition. In other words there are a plurality of configurations of the rotatable element 104 with respect to the locking element 30 which correspond to the locked condition, in which rotation of the rotatable element 104 is inhibited. In the embodiment illustrated in FIGS. 1 to 9*b*, the plurality of configurations are defined by the arrangement of projections and corresponding recesses provided on the rotatable element 104 and the locking element 30.

The locking element 30 and rotatable element 104 comprise a plurality of projections 106 and plurality of corresponding recesses 108 which are configured for engagement upon relative movement of the locking element 30 towards the rotatable element 104 in a direction along the axis of rotation A of the rotatable element 104. In this way when the projections 106 engage the corresponding recesses 108, rotation of the rotatable element 104 is inhibited. In the illustrated embodiments, the plurality of projections are provided by the rotatable element 104 and the plurality of recesses are provided by the locking element 30. Alternatively a plurality of projections may be provided by the locking element 30 and a plurality of corresponding recesses may be provided by the rotatable element 104.

The projections 106 and corresponding recesses 108 are provided in a circular arrangement centred about the axis of rotation A of the rotatable element 104. In this way there are a plurality of configurations in which the rotatable element and the locking element 30 can be engaged.

Further, the projections 106 and recesses 108 are arranged to self-align when the locking element 30 and the rotatable element 104 are biased into contact. In other words, the action of the compression spring 28 and the configuration of the projections 106 and recesses 108 is such that the rotatable element 104 and the locking element 30 will tend towards engagement with one another.

In the embodiment illustrated in FIGS. 1 to 9*b*, for example as shown in FIG. 7*a*, the projections 106 are provided by an array of teeth on the rotatable element 104. Alternatively, such an array of teeth may be provided on the locking element 30. As can be seen from FIG. 7*b*, the plurality of recesses are provided between splines 110 of an array of splines 110 provided on the locking element 30. Alternatively, the array of splines 110 may be provided on the rotatable element 104.

In some embodiments, a single projection 106 may be provided together with an array of corresponding recesses. Alternatively, a single recess 108 may be provided together with an array of corresponding projections 106. Such arrangements would also provide a plurality of configurations which correspond to the locked condition.

Figure 7D:
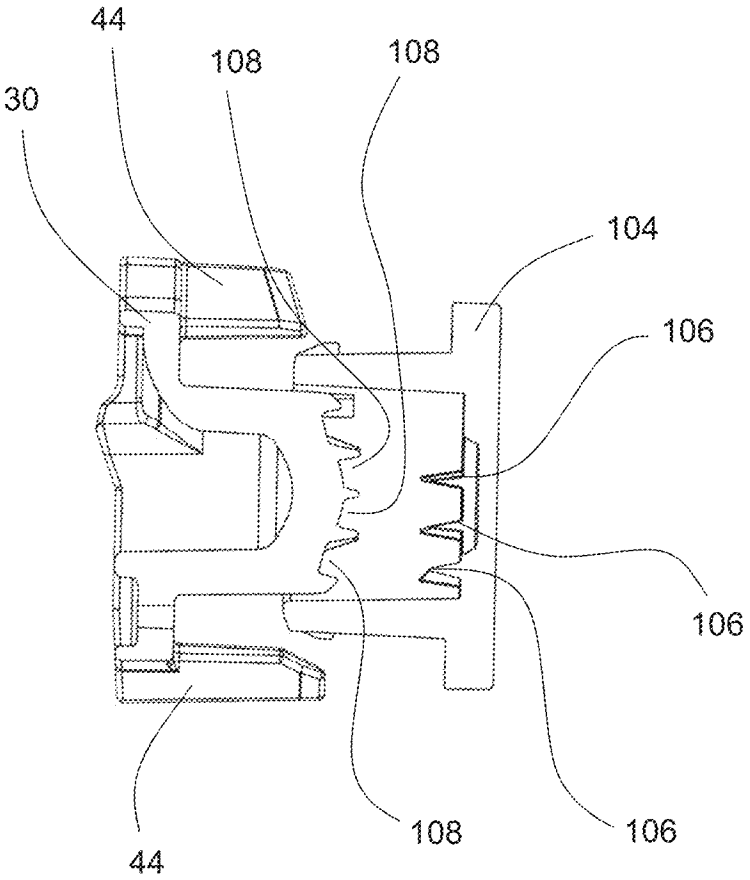
FIGS. 7*c* and 7*d* show the lock arrangement of the mounting portion of FIG. 3*a* when in the locked condition and free condition respectively.
Figure 7C:
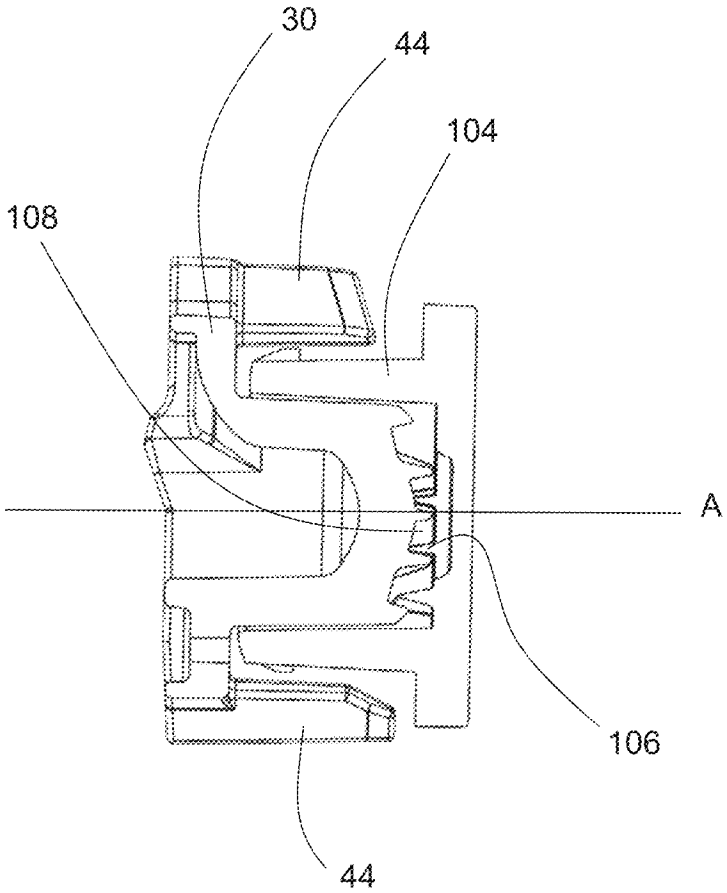

With reference to FIG. 7*c*, the configuration in which the locking element 30 and the rotatable element 104 are engaged is illustrated. As can be seen, the projections 106 engage recesses 108 to lock the rotatable element 104 and the locking element 30 together. In this configuration, rotation of the rotatable member 104 about the axis of rotation A is inhibited or prevented.

FIG. 7*d* illustrates the configuration in which the rotatable element 104 and the locking element 30 are not engaged. In this configuration, the projections 106 do not engage the corresponding recesses 108, accordingly rotation of the rotatable element 104 about the axis A is permitted. When the roll 4 is mounted on the rotatable element 104, rotation of the rotatable element 104 enables the roll 4 to be rotated, hence the dispenser can be used.

As is illustrated in FIGS. 8*a* to 8*d*, the locking element 30 is configured to be retracted out of engagement with the rotatable element 30 by movement of the key 16*a* from the disengaged to the engaged position. As the roll 4 is moved from the disengaged condition (as shown in FIG. 8*a*) to the engaged position (as shown in FIG. 8*c*) the key 16*a* abuts a portion of the locking element 30 to disengage the locking element 30 from the rotatable element 104. For example, a front face 112 of the body 40 of the locking element 30 (as shown in FIG. 7*b*) is engaged by the key 16*a* as it moves from the disengaged to the engaged condition. The front face 112 of the locking element is configured to abut a rear face 114 of the rotatable element 104 as shown in FIG. 8*a*, for example.

As previously described, the key 16*a* comprises one or more projections 56 which are arranged to be received by corresponding key holes 58. As shown in FIG. 3*a*, the key holes 58 are provided by the rotatable element 104. In this way, the roll 4 is supported by the rotatable element 104.

With reference to FIGS. 8*a* to 8*f*, operation of the dispenser 2 to load a correct roll of sheet material 4 into the dispenser 2 will now be described. The first end 16 of the roll of sheet material 4 is located with respect to the mounting portion 10. The second end 18 of the roll 4 is then positioned with respect to the support member 18.

When there is no roll loaded in the dispenser 2, the tilting member 22 is in the loading position. In this configuration the keyholes 58 of the tilting member 22 are angled towards a user, facilitating loading of the roll 4 onto the mounting portion 10.

As the first end of the roll 4 is brought into contact with the mounting portion 10, the key 16*a* of the roll 4 is positioned in the key holes 58. In this way, the roll 4 is moved from a disengaged position to an engaged position. With reference to FIGS. 8*a* to 8*c*, as the key 16*a* is moved from the disengaged to the engaged condition, the key 16*a* abuts the front face 112 of the locking element 30 to move the locking element 30 away from the rotatable element 104 and away from the tilting member 22. This movement is against the biasing action of the compression spring 28.

As the locking element 30 is moved by the key 16*a*, it is moved out of engagement with the rotatable element 104. Consequently the projections 106 and the corresponding recesses 108 disengage such that rotation of the rotatable member 104 is permitted. In this way, the lock arrangement 102 is unlocked.

Movement of the locking element 30 against the biasing action of the compression spring 28 also causes the wing portions 38 of the locking element 30 to move past the stop blocks 34 of the mounting portion 10. This is shown in FIG. 8*d*. Disengagement of the stop blocks 34 and the wing portions 38 unblocks the block arrangement 26, thereby permitting rotation of the tilting member 22 about pivot pin 24. In this way, the tilting member 22 is released for movement from the loading position to the operative position. As the tilting member 22 is rotated about the pivot pin 24 the roll 4 is located in the housing 6 and the second end 20 of the roll 4 is brought into contact with the support portion 18. The roll 4 is now loaded in the dispenser 2 for use.

It will be appreciated that a roll which does not comprise a key or a key of the correct configuration will not correctly engage with the mounting portion 10 to unblock the block arrangement 26. Accordingly mounting of the roll in the housing 6 will be inhibited. Further, a roll which does not comprise a key or the correct configuration of key will not unlock the lock arrangement 102. Consequently rotation of the roll will be prevented since the rotatable element 104 will not be free for rotation.

It will also be appreciated that the act of a user engaging the roll with the mounting portion 10 has two effects: unblocking the block arrangement to permit loading of the roll in the housing, and unlocking the lock arrangement to permit rotation of the roll.

Figure 9B:
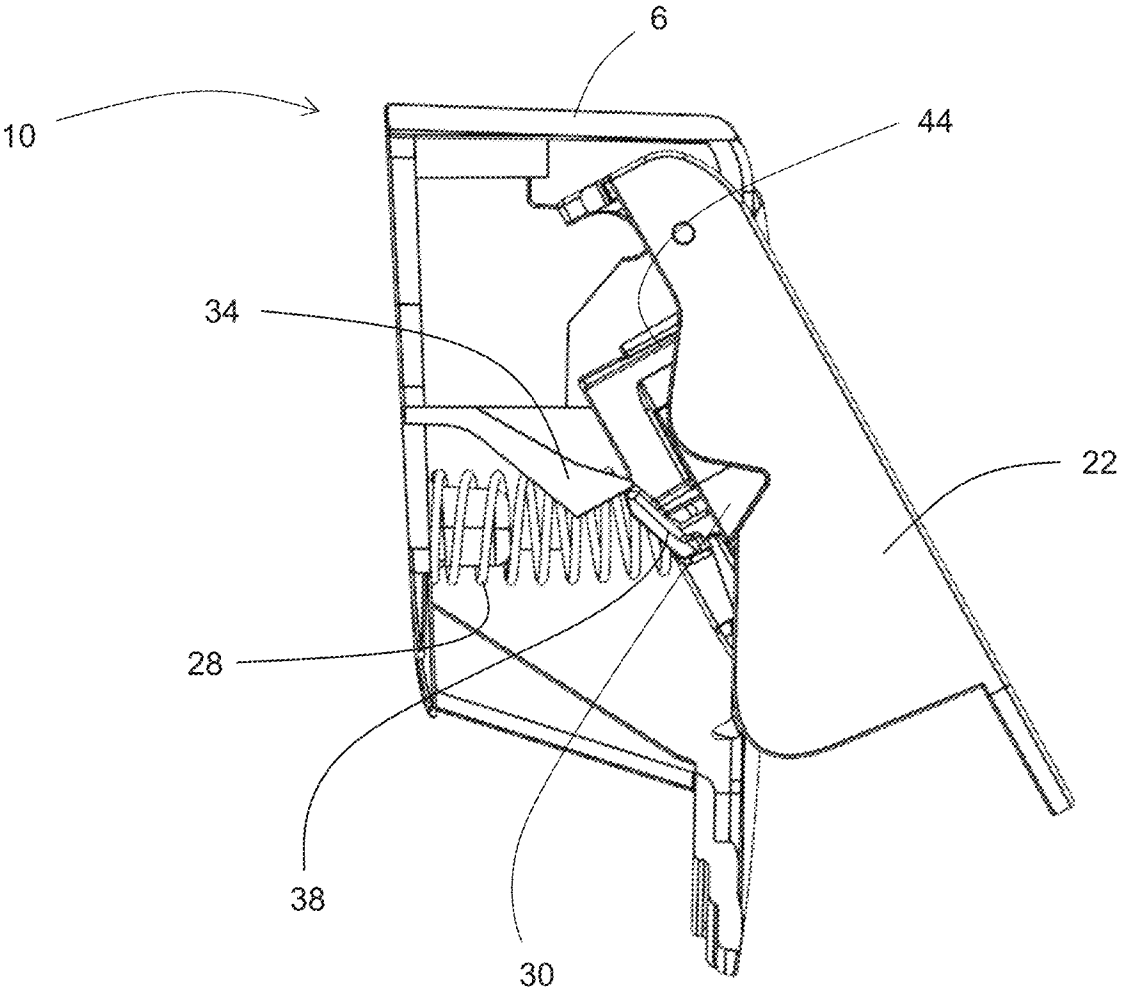

When a user wishes to replace a roll of sheet material 4 or change a correct roll of sheet material for another roll 4, a roll occupying the housing 6 may be removed by reversing the action described above. This is shown by FIGS. 9*a* and 9*b*.

As the key 16*a* is removed from the key hole 58, i.e. as the key 16*a* is moved from the engaged to the disengaged position, the action of the compression spring 28 biases the locking element 30 into engagement with the rotatable member 104. In this way rotation of the rotatable member 104 is inhibited.

In addition, the action of the compression spring 28 against the locking element 30 biases the locking element 30 towards a rear surface of the tilting member 22 (the rear surface of the tilting member 22 may or may not be the same as the rear surface of the rotatable element 104). This biases the tilting member 22 from the operative condition to the loading condition. As the locking element 30 moves in this way, the wing portions 38 are brought back into engagement with the stop blocks 34 to retain the tilting member 22 in the loading position. In this loading position, the dispenser 2 is then ready for a new roll 4 to be inserted.

The spring rate of the compression spring 28 is selected to be a predetermined value. In the present arrangement, the spring rate is selected to be approximately 3N, but the spring rate may be varied to suit the application. This provides a number of advantages. For example, appropriate selection of the spring rate may: ensure that the spring can overcome the force of gravity to return the tilting member to the loading position from the operative position; provide appropriate tactile feedback to a user when loading or unloading a roll in the dispenser; bias the mounting portion into engagement with the roll to secure the roll in the dispenser housing.

Selection of the spring rate is also advantageous to ensure engagement of the locking element 30 with the rotatable member 104 as the key is removed from the mounting portion, to restrict rotation of the rotatable member when the correct roll of material is removed.

Although the invention has been described with reference to one or more embodiments, it will be appreciated that various changes or modifications may be made without departing from the scope of the invention as defined in the appended claims. For example whilst embodiment illustrated in FIGS. 1 to 9*b* comprises both a block arrangement 26 and a lock arrangement 102, it will be appreciated that a dispenser may include only one of these arrangements.

Figure 10B:
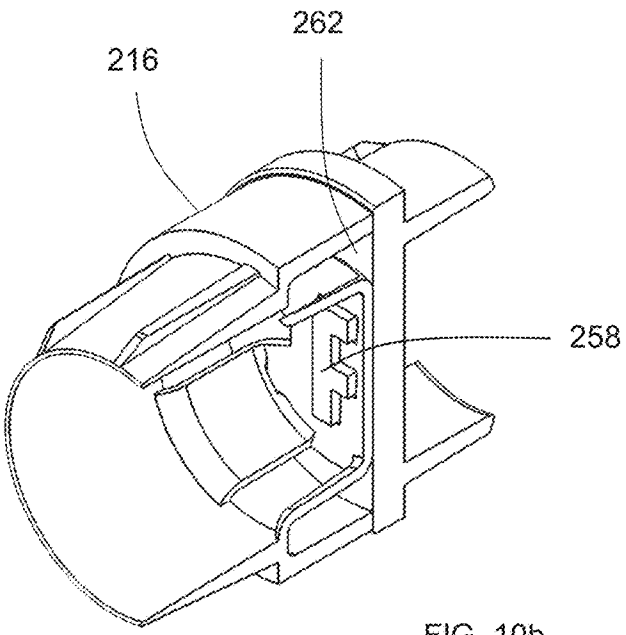
FIGS. 10*a* and 10*b* show a cross-sectional view of an alternative embodiment of the first end portion of the roll and the rotatable element of the mounting portion.
Figure 10A:
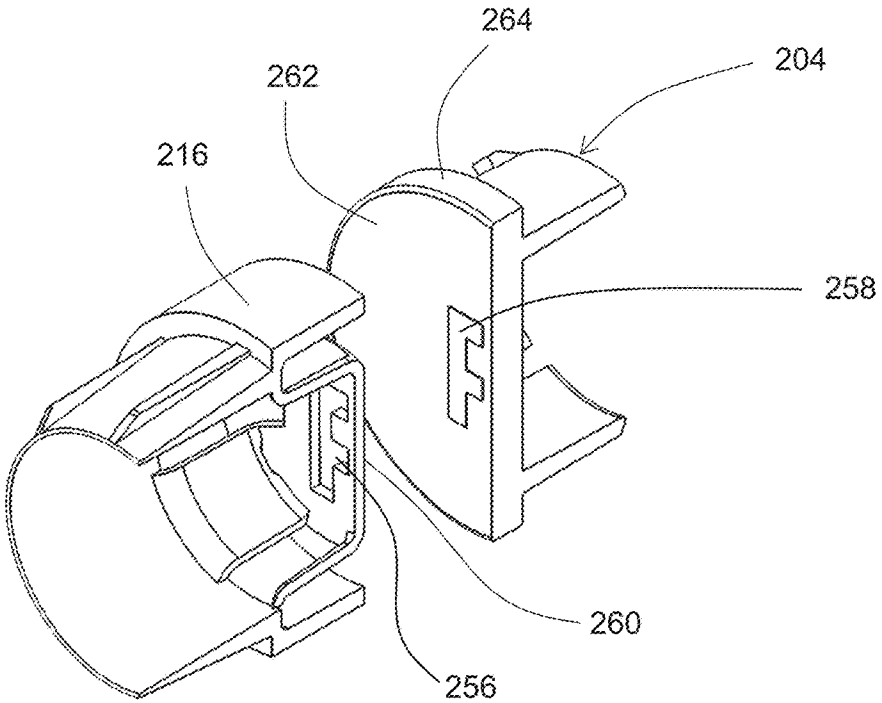

In an alternative embodiment shown in FIGS. 10*a* and 10*b*, a roll is provided having a first end portion 216. The first end portion comprises an axial end face 260 provided with a key 216*a* in the form of a depression or recess 256.

The mounting portion 10 comprises a corresponding formation 258 formed in a surface 262 of the mounting portion 10, e.g. the surface of the rotatable element 204. The formation 258 is configured for engagement with the depression or recess 256 of the key 216*a*. When the formation 258 of the mounting portion 10 is received in the depression or recess 256 of the key 216, the roll is in the engaged condition as shown in FIG. 10*b*. When the formation 258 of the mounting portion 10 is not occupying the depression or recess 256 of the key 216, the roll is in the disengaged condition as shown in FIG. 10*a*.

It will be appreciated that, when the roll is in the engaged condition, the first end portion 216 is supported by the formations 258, which occupy the depression or recess 256 of the first end portion 216.

As can be seen by comparing FIGS. 10*a* and 10*b*, as the roll moves from the disengaged to the engaged condition, the axial end face 260 of the first end portion 216 comes into contact with the surface 262 surrounding the formation 258 of the mounting portion 10. As force is applied to the roll, the surface 262 of the mounting portion 10 is depressed away from the formation 258. In this way the formation 258 is exposed so that it can occupy the depression or recess 256 of the key 216*a*.

In the embodiment illustrated in FIGS. 10*a* and 10*b*, the formation 258 of the mounting portion is provided in the rotatable element 204. In such a configuration, movement of the rotatable element 204 by the axial end face 260 causes the rotatable element 204 to be moved out of engagement with a locking element (not shown). For example, the locking element may be provided by the rear surface 42 of the tilting member 22 or another suitable portion of the mounting portion 10 or housing 6. In such embodiments, the rotatable member 204 may comprise projections and/or recesses (not shown) on its surface 262 or on a side wall 264 of the surface, such projections and/or recesses being configured for engagement with corresponding recesses and/or projections of the locking element.

In the embodiment illustrated in FIGS. 10*a* and 10*b*, the rotatable element 204 may act as the blocking member. In such an embodiment, movement of the rotatable element 204 by the axial end face 260 of the roll causes the rotatable element 204 to be moved out of engagement with blocking formations (not shown), thereby unblocking the block arrangement.

Whilst in the embodiment illustrated in FIGS. 10*a* and 10*b*, the formation 258 of the mounting portion 10 is provided by the rotatable element 204, it will be appreciated that the formation 258 may be provided in any suitable element of the mounting portion 10.

Further, the embodiment illustrated in FIGS. 1 to 9*b* comprises a roll having projections 56 in a substantially "F"-shaped formation and correspondingly shaped keyholes 58 provided on the mounting portion 10. It will be appreciated that any suitable formation of the projections 56 of the key 16*a* may be used. Further, one or more projections 56 of any suitable shape may be used. Corresponding keyholes 58 of the mounting portion may be provided to support such key arrangements.

Figure 11A:
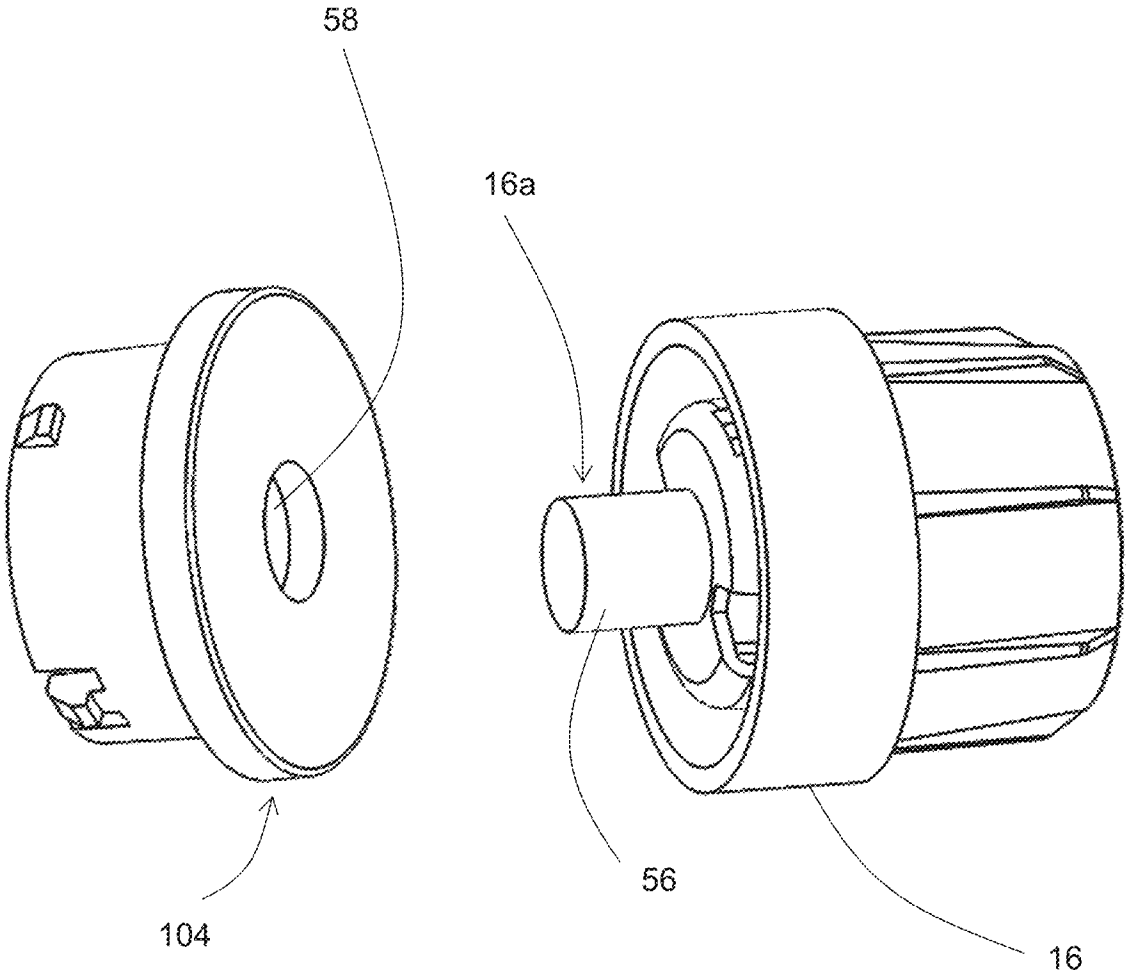
FIGS. 11*a* to 11*g* show perspective views of alternative embodiments of the key of the first end portion of the roll and corresponding keyholes of the mounting portion.
Figure 11B:
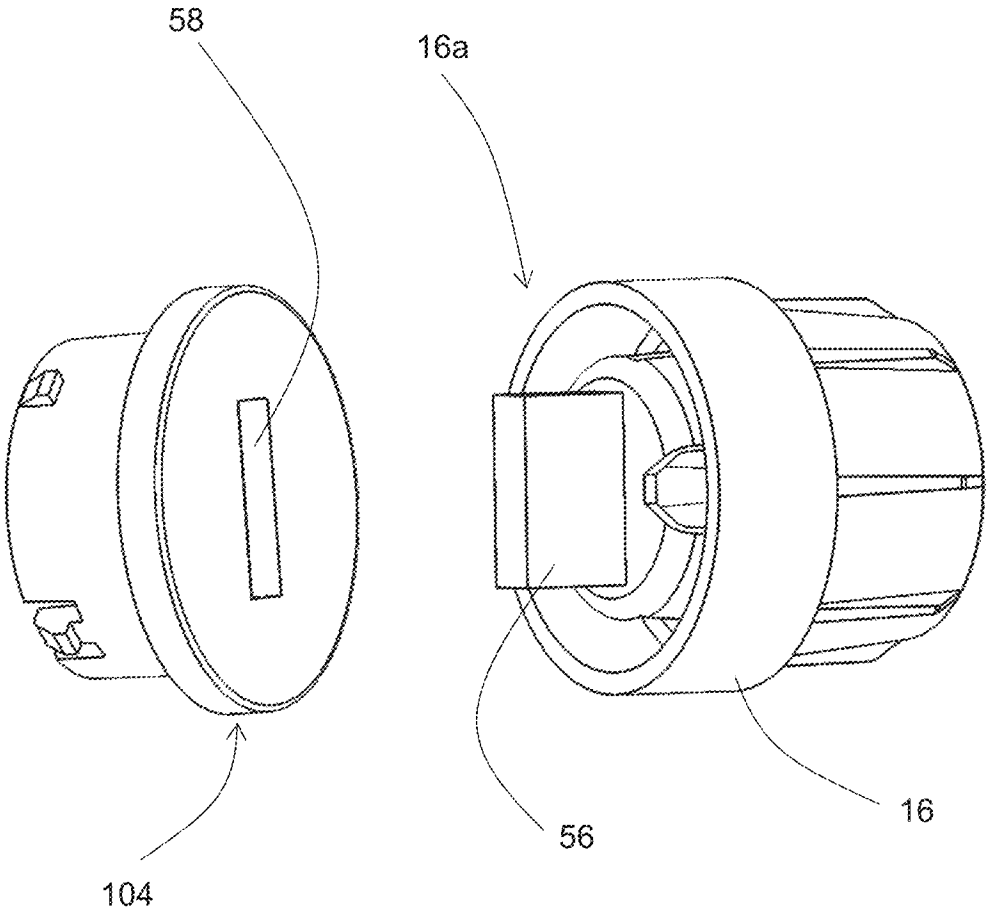
Figure 11C:
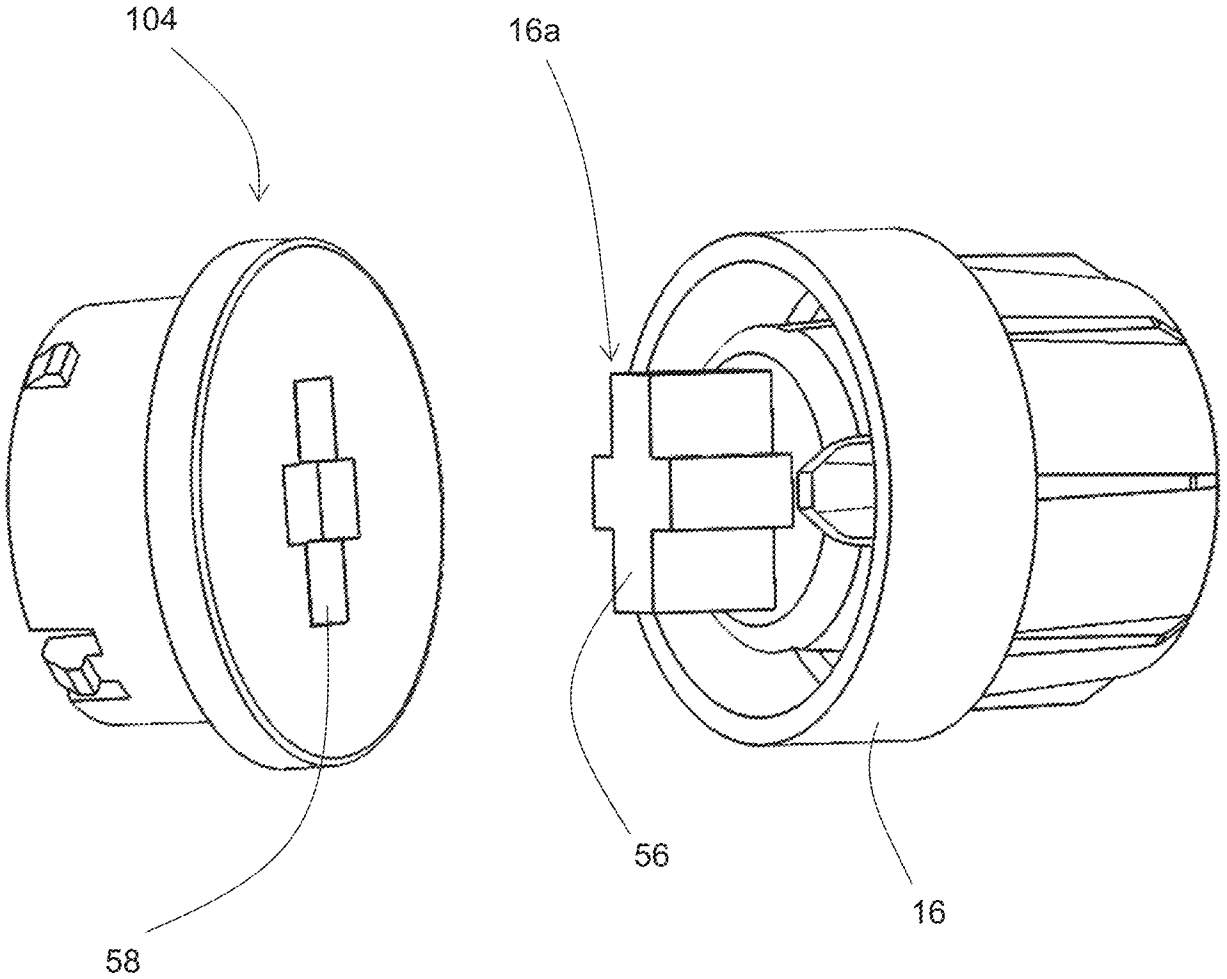

For example, as shown in FIGS. 11*a* to 11*c*, the key 16*a* may comprise a single projection 56, for example having a circular cross section (see FIG. 11*a*), a rectangular cross section (see FIG. 11*b*), or a cross-shaped cross section (see FIG. 11*c*). It will be appreciated that a projection having any suitable cross section may be used.

Figure 11D:
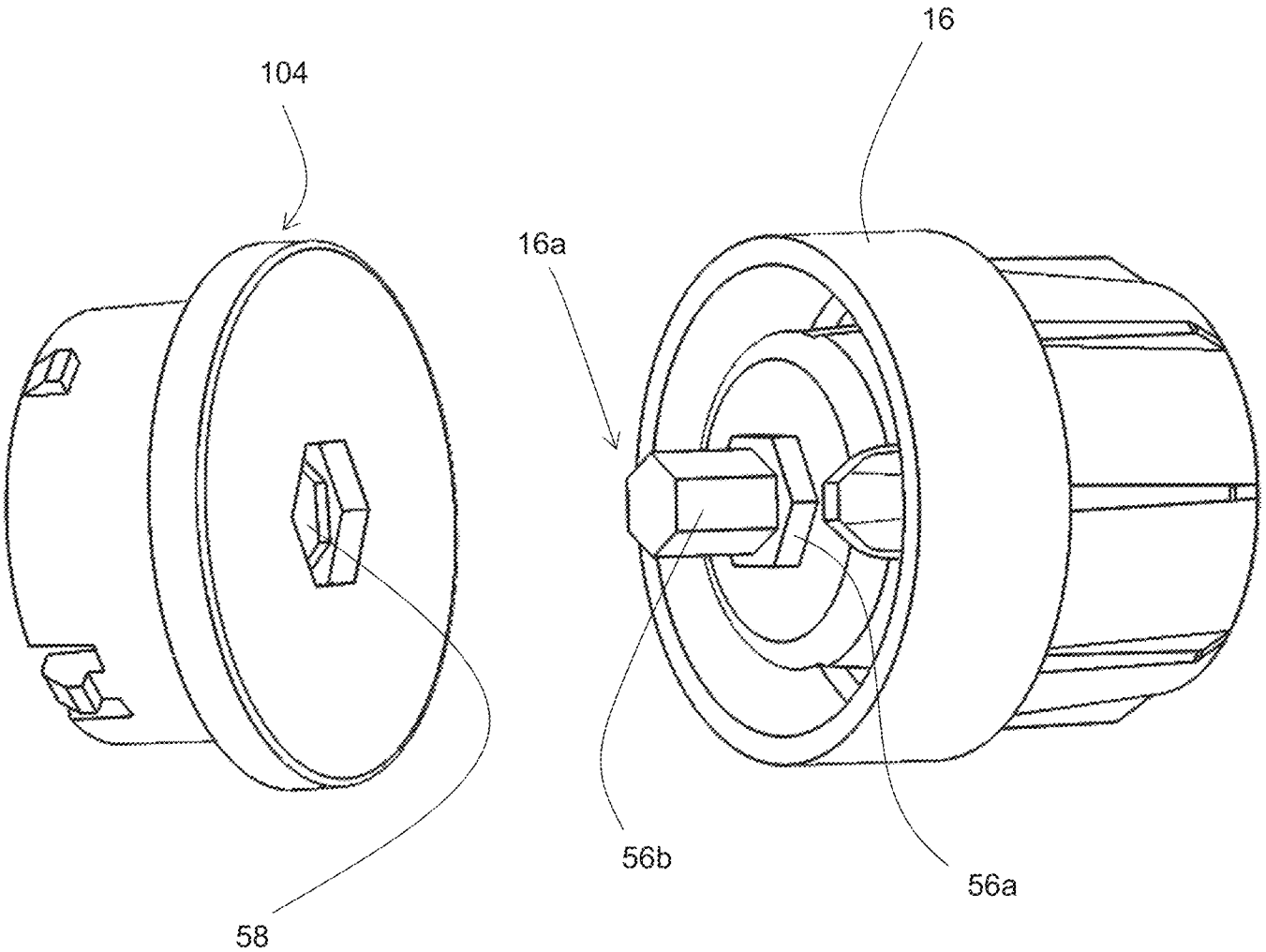
Figure 11E:
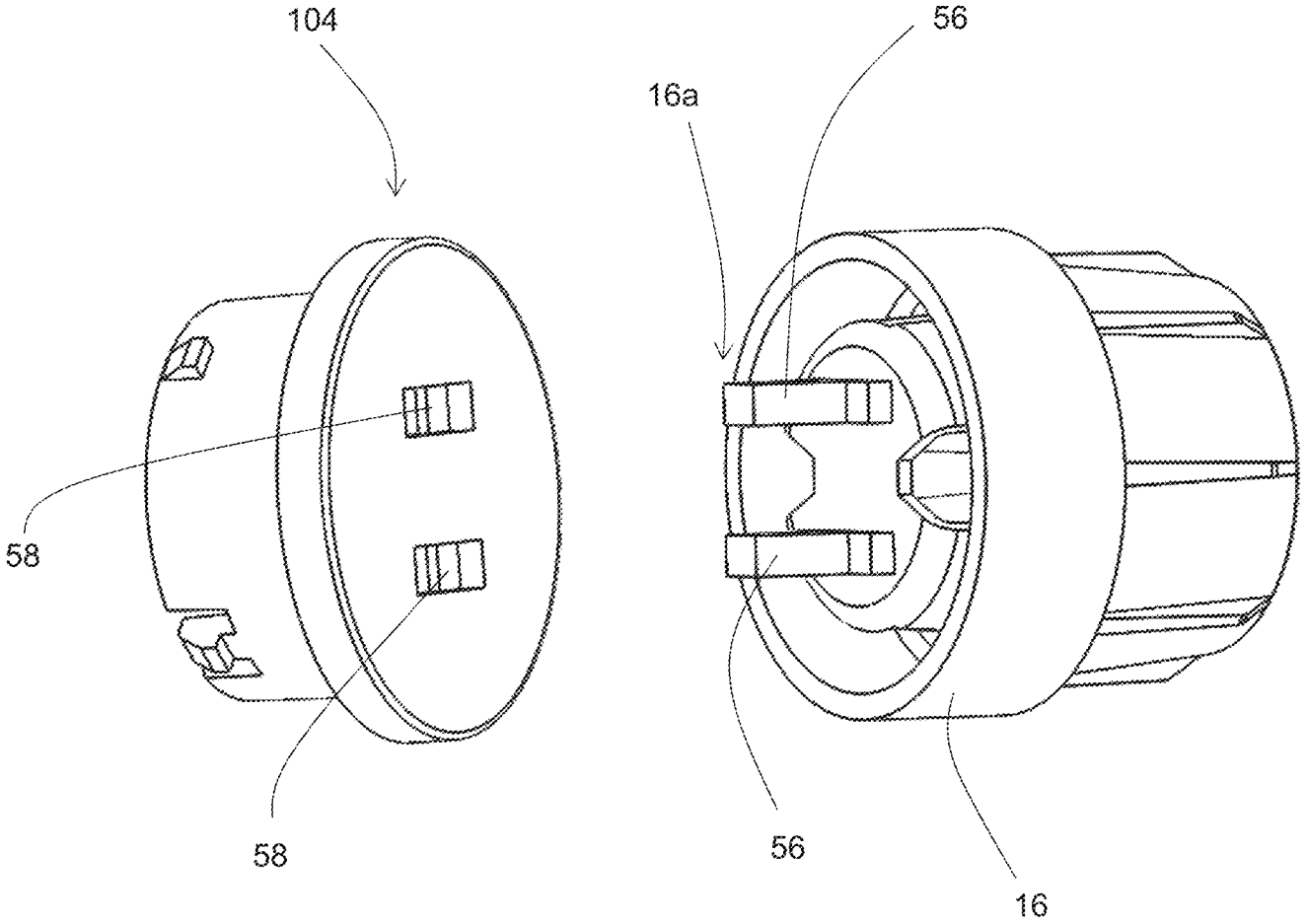
Figure 11F:
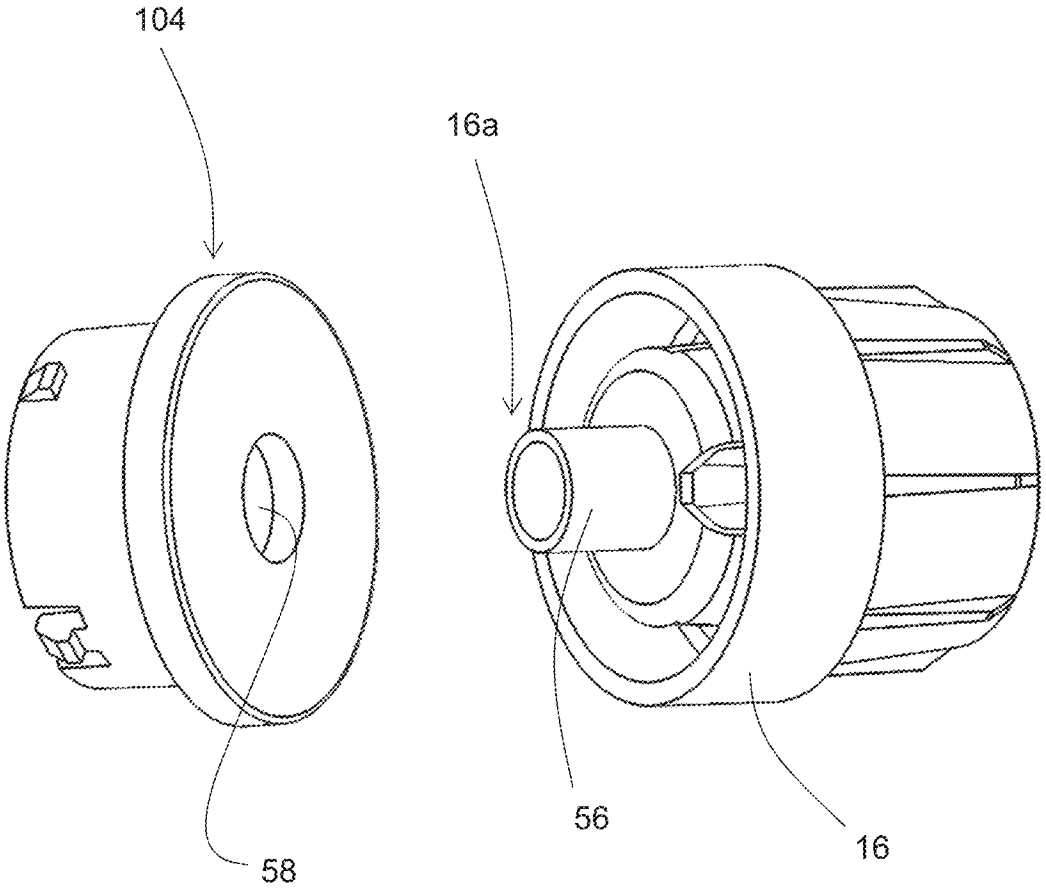
Figure 11G:
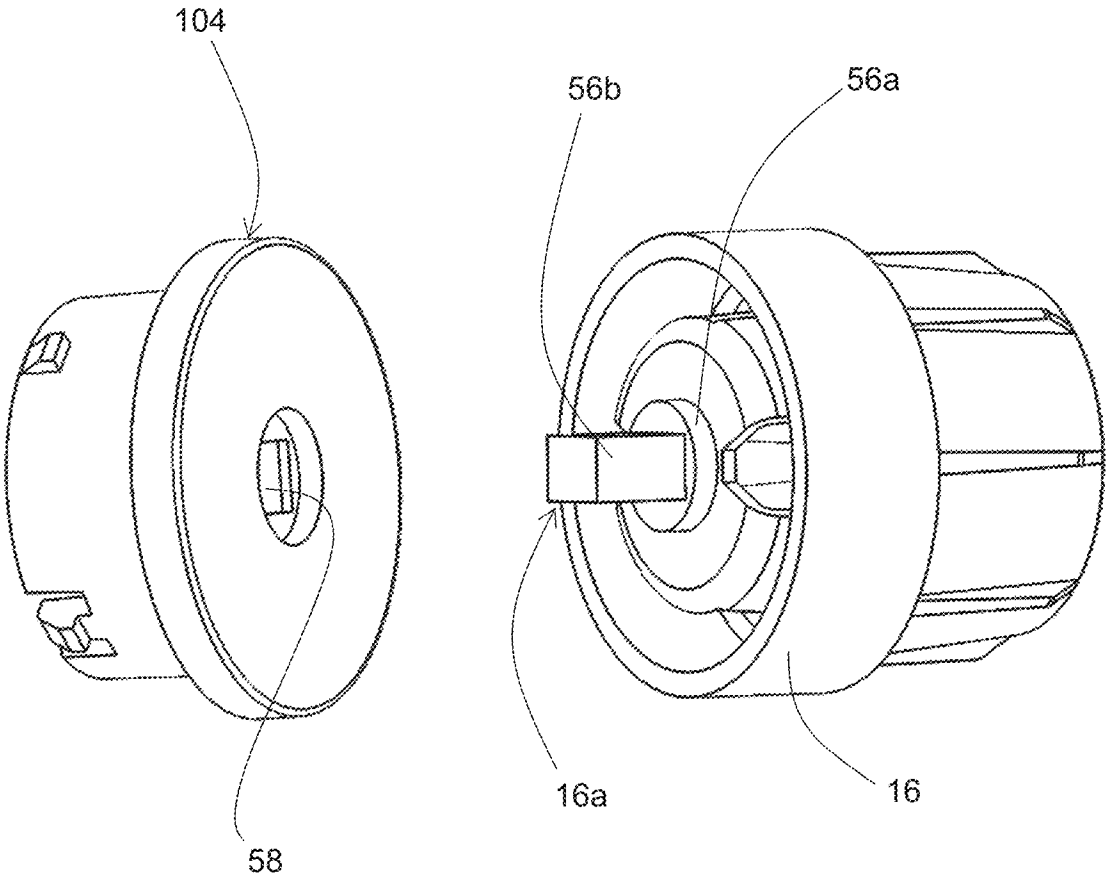

FIGS. 11*d* and 11*g* illustrate embodiments in which the key 16*a* comprises a first projection 56*a* extending from the end of the roll by a first depth, and a second projection 56*b* extending from the first projection 56*a*, such that the second projection 56*b* extends from the roll by a second depth which is greater than the first depth. In the embodiment of FIG. 11*d*, both the first and second projections have a hexagonal cross section, which are angularly offset from one another in the illustrated embodiment. It will be appreciated that the cross sections of the first and second projections may be angularly aligned. In FIG. 11*g*, the first projection has a circular cross section and the second projection has a square cross section. It will be appreciated that the first and second projections may comprise any suitable cross section, and that the first and second projections may comprise the same or different cross sections.

FIG. 11*e* illustrates an embodiment in which the key 16*a* comprises a pair of projections 56 having a substantially L-shaped profile, configured such that the long side of the L-shaped profile extends away from the roll.

Finally, FIG. 11*f* illustrates an embodiment in which the key 16*a* comprises a single projection 56 comprising a hollow cylindrical profile.

Whilst the embodiments illustrated in FIGS. 11*a* to 11*g* show the keyholes 58 being provided by the rotatable portion 104 of the mounting portion, it will be appreciated that the keyholes may be provided by any suitable portion of the mounting portion or dispenser housing.

In some embodiments the shape and/or configuration of the key 16*a* formed at the first end of the roll 4 corresponds to the size of the roll, the type of material on the roll, and/or other properties relating to the roll. It will be appreciated that appropriate dispensers for the respective type of roll will have corresponding key holes. This ensures that only correct rolls are loaded in a particular dispenser, and that it is easy for a user to identify the correct roll.

For example, some rolls may be too long or too short for a given dispenser. In some examples, the material loaded on the roll may be of a particular thickness that requires the dispenser to have a sufficiently robust cutting mechanism in order to dispense the material. Accordingly, providing a particular key arrangement for a particular type of roll further ensures that only the correct rolls are loaded into a given dispenser.

The invention claimed is:

1. A sheet dispenser system having a roll of sheet material and a housing to receive the roll, wherein:

the roll of sheet material comprises a first end portion incorporating a key; and the housing comprises a mounting portion arranged to support the first end portion of the roll; wherein the mounting portion comprises a lock arrangement which is movable between a locked condition and an free condition; wherein the lock arrangement comprises a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition; wherein the mounting portion is arranged such that the roll is movable between an engaged condition, in which the key engages the mounting portion, and a disengaged condition, in which the key is disengaged from the mounting portion, such that, when the roll is moved from the disengaged to the engaged condition, the first end portion of the roll moves the lock arrangement into the free condition, thereby permitting rotation of the rotatable element; and wherein the locking element and the rotatable element are configured for engagement by relative movement of the locking element and the rotatable element towards each other in a direction along the axis of rotation of the rotatable element.

2. A sheet dispenser system according to claim 1, wherein the mounting portion comprises a biasing mechanism arranged to bias the lock arrangement into the locked condition, in which rotation of the rotatable element is inhibited, wherein the biasing mechanism is arranged to bias the locking element into engagement with the rotatable element, or vice versa.

3. A sheet dispenser system according to claim 1, wherein the mounting portion is configured such that, when the rotatable element is free to rotate, rotation of the roll in the housing is permitted, wherein the rotatable element is configured to support the first end portion of the roll.

4. A sheet dispenser system according to claim 1, wherein the locking element and rotatable element comprise a projection and corresponding recess which are configured for engagement upon relative movement of the locking element towards the rotatable element in a direction along the axis of rotation of the rotatable element such that, when the projection engages the corresponding recess, rotation of the rotatable element is inhibited.

5. A sheet dispenser system according to claim 4, wherein the one or more projections and the one or more recesses are arranged to self-align when the locking element and the rotatable element are biased into contact.

6. A sheet dispenser system according to claim 5, wherein the locking element is configured to be retracted out of engagement with the rotatable element by movement of the first end portion of the roll as the roll is moved from the disengaged to the engaged position, wherein, as the roll is moved from the disengaged to the engaged condition, the first end portion of the roll is configured to abut a portion of the locking element to disengage the locking element from the rotatable element.

7. A sheet dispenser system according to claim 6, wherein the key comprises one or more projections, and wherein the mounting portion defines one or more corresponding keyholes configured to receive the one or more projections of the key to support the first end of the roll, wherein the rotatable element comprises the one or more keyholes wherein the key of the first end portion is configured to abut a portion of the locking element to disengage the locking element from the rotatable element.

8. A sheet dispenser system according to claim 1, wherein the lock arrangement comprises a plurality of configurations which correspond to the locked condition.

9. A sheet dispenser system according to claim 8, wherein the locking element and rotatable element comprise a plurality of projections and corresponding recesses which are configured for engagement upon relative movement of the locking element towards the rotatable element in a direction along the axis of rotation of the rotatable element, such that, when the projections engage the corresponding recesses, rotation of the rotatable element is inhibited.

10. A sheet dispenser system according to claim 9, wherein the projections and corresponding recesses are provided in a circular arrangement centred about the axis of rotation of the rotatable element.

11. A sheet dispenser system according to claim 1, wherein the housing further comprises a support portion arranged to support a second end of the roll, and wherein the mounting portion further comprises a tilting member pivotally coupled to the housing to define an operative position, in which the mounting portion and the support portion are aligned to support the roll in the housing, and a loading position, in which the mounting portion and the support portion are unaligned to inhibit support of the roll in the housing wherein the mounting portion further comprises a block arrangement which is movable between a blocked condition, in which movement of the tilting member from the loading position to the operative position is inhibited, and a unblocked condition, in which movement of the tilting member from the loading position to the operative position is permitted, and wherein the mounting portion is arranged such that, when the roll is moved from the disengaged to the engaged condition, the first end portion of the roll moves the block arrangement into the unblocked condition, thereby permitting movement of the tilting member from the loading position to the operative position.

12. A sheet dispenser system according to claim 11, wherein the block arrangement comprises a blocking element which is actuatable by the first end portion of the roll to move the block arrangement from the blocked condition to the unblocked condition, and wherein the locking element and the blocking element are provided by the same component.

13. A mounting system for a sheet dispenser system having a roll of sheet material and a housing to receive the roll, wherein the mounting system comprises:

a first end portion of a roll of sheet material incorporating a key; and a corresponding mounting portion of a housing, the mounting portion arranged to support the first end portion of the roll; wherein the mounting portion comprises a lock arrangement which is movable between a locked condition and an free condition; wherein the lock arrangement comprises a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition; wherein the mounting portion is arranged such that the first end portion of the roll is movable between an engaged condition, in which the key engages the mounting portion, and a disengaged condition, in which the key is disengaged from the mounting portion, such that, when the first end portion of the roll is moved from the disengaged to the engaged condition, the first end portion moves the lock arrangement into the free condition, thereby permitting rotation of the rotatable element; and wherein the locking element and the rotatable element are configured for engagement by relative movement of the locking element and the rotatable element in a direction towards each other along the axis of rotation of the rotatable element.

14. A sheet dispenser comprising a housing for receiving a roll of sheet material, the roll comprising a first end portion incorporating a key, wherein:

the housing comprises a mounting portion arranged to support said first end portion of said roll; wherein the mounting portion comprises a lock arrangement which is movable between a locked condition and a free condition; wherein the lock arrangement comprises a rotatable element configured for rotation about an axis, and a locking element configured for engagement with the rotatable element to inhibit rotation of the rotatable element, such that, when the locking element and the rotatable element are engaged, the lock arrangement occupies the locked condition, and when the locking element and the rotatable element are disengaged, the lock arrangement occupies the free condition; wherein the mounting portion is arranged such that said first end portion of said roll is movable between an engaged condition, in which said key engages the mounting portion, and a disengaged condition, in which said key is disengaged from the mounting portion, such that, when said first end portion of said roll is moved from the disengaged to the engaged condition, said first end portion moves the lock arrangement into the free condition, thereby permitting rotation of the rotatable element; and wherein the locking element and the rotatable element are configured for engagement by relative movement of the locking element and the rotatable element towards each other in a direction along the axis of rotation of the rotatable element.

15. A sheet dispenser according to claim 14, wherein the housing further comprises a support portion arranged to support a second end of the roll, and wherein the mounting portion further comprises a tilting member pivotally coupled to the housing to define an operative position, in which the mounting portion and the support portion are aligned to support the roll in the housing, and a loading position, in which the mounting portion and the support portion are unaligned to inhibit support of the roll in the housing;

wherein the mounting portion further comprises a block arrangement which is movable between a blocked condition, in which movement of the tilting member from the loading position to the operative position is inhibited, and a unblocked condition, in which movement of the tilting member from the loading position to the operative position is permitted; and wherein the mounting portion is arranged such that, when the roll is moved from the disengaged to the engaged condition, the first end portion of the roll moves the block arrangement into the unblocked condition, thereby permitting movement of the tilting member from the loading position to the operative position.

16. The use of a replacement roll of sheet material with a sheet dispenser according to claim 14, wherein the replacement roll comprises one or more mounting formations and the mounting portion of the dispenser comprises one or more complimentary formations configured to support the one or more mounting formations of the replacement roll, and wherein the use comprises mounting the one or more formations of the replacement roll onto the one or more complimentary formations of the mounting portion of the sheet dispenser.

17. A method of removing a roll of sheet material from a sheet dispenser according to claim 14, wherein the mounting portion of the sheet dispenser comprises a biasing mechanism arranged to bias at least one of: the lock arrangement to the locked condition, a tilting member towards the loading position, and a block arrangement to the blocked condition; the method comprising the steps of:

a. dismounting a roll of sheet material from the mounting portion of the housing; and b. when the biasing mechanism is arranged to bias the lock arrangement to the locked condition, releasing the lock arrangement for movement, such that the lock arrangement is moved, under the biasing action of the biasing mechanism, to the locked condition in which rotation of the rotatable element is inhibited; when the biasing mechanism is arranged to bias the tilting member towards the loading position, releasing the tilting member for movement, such that the tilting member is moved from the operative position to the loading position under the biasing action of the biasing mechanism; and when the biasing mechanism is arranged to bias the block arrangement to the blocked condition, releasing the block arrangement for movement, such that the block arrangement is moved, under the biasing action of the biasing mechanism, to the blocked condition in which movement of the tilting member from the loading position to the operative position is inhibited.

18. A replacement roll of material for use with a sheet dispenser according to claim 14, wherein the replacement roll of material comprises one or more mounting formations which are arranged to be supported by the mounting portion of the sheet dispenser when a block arrangement is in the or an unblocked condition and/or when the lock arrangement is in the free condition.

19. A sheet dispenser system comprising a sheet dispenser according to claim 14 and a replacement roll of material, wherein the replacement roll of material comprises one or more mounting formations which are arranged to be supported by the mounting portion of the sheet dispenser when a block arrangement is in an unblocked configuration and/or when the lock arrangement is in the free condition.

20. A method of mounting a replacement roll of sheet material into a sheet dispenser according to claim 14, comprising the steps of:

a. moving a key from the disengaged to the engaged condition such that a block arrangement is moved into an unblocked condition, in which movement of the tilting member from the loading position to the operative position is permitted; and/or b. moving a key from the disengaged to the engaged condition such that the lock arrangement is moved into the free condition, in which rotation of the rotatable element is permitted; and c. mounting a first end of the replacement roll into the mounting portion of the dispenser.

* * * * *